US008587512B2

(12) United States Patent
Hiji et al.

(10) Patent No.: US 8,587,512 B2
(45) Date of Patent: Nov. 19, 2013

(54) DISPLAY DEVICE COMPRISING A SINGLE, CONTINUOUS DISPLAY ELECTRODE, A PERFORATED INTERMEDIATE ELECTRODE, AND PLURAL PIXEL ELECTRODES

(75) Inventors: Naoki Hiji, Minamiashigara (JP); Masaaki Abe, Minamiashigara (JP); Yoshinori Machida, Minamiashigara (JP); Ryota Mizutani, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 485 days.

(21) Appl. No.: 12/790,337

(22) Filed: May 28, 2010

(65) Prior Publication Data

US 2011/0141087 A1 Jun. 16, 2011

(30) Foreign Application Priority Data

Dec. 11, 2009 (JP) ..... 2009-281708

(51) Int. Cl.
*G09G 3/34* (2006.01)

(52) U.S. Cl.
USPC ..... 345/107

(58) Field of Classification Search
USPC ..... 345/107; 359/296
See application file for complete search history.

(56) References Cited

U.S. PATENT DOCUMENTS

| | | | | |
|---|---|---|---|---|
| 4,203,106 | A | 5/1980 | Dalisa et al. | |
| 4,741,988 | A * | 5/1988 | Van der Zande et al. | 430/312 |
| 5,041,824 | A * | 8/1991 | DiSanto et al. | 345/107 |
| 5,293,528 | A * | 3/1994 | DiSanto et al. | 345/107 |
| 6,337,761 | B1 * | 1/2002 | Rogers et al. | 359/296 |
| 8,384,659 | B2 * | 2/2013 | Yeo et al. | 345/107 |
| 2002/0005832 | A1 * | 1/2002 | Katase | 345/107 |
| 2002/0167480 | A1 * | 11/2002 | Johnson et al. | 345/107 |
| 2003/0011869 | A1 | 1/2003 | Matsuda et al. | |
| 2003/0038772 | A1 * | 2/2003 | De Boer et al. | 345/107 |

(Continued)

FOREIGN PATENT DOCUMENTS

| | | |
|---|---|---|
| JP | 54-85699 | 7/1979 |
| JP | 7-504048 | 4/1995 |
| JP | 2001-282143 A | 10/2001 |
| JP | 2003-005229 A | 1/2003 |
| JP | 2005-010781 A | 1/2005 |

(Continued)

OTHER PUBLICATIONS

Japanese Office Action dated Jun. 18, 2013, issued by the Japanese Patent Office in Japanese Patent Application No. 2009-281708.

*Primary Examiner* — Chanh Nguyen
*Assistant Examiner* — Navin Lingaraju
(74) *Attorney, Agent, or Firm* — Sughrue Mion, PLLC

(57) ABSTRACT

There is provided a display device including a voltage application device that performs, with respect to a display medium including, a pair of substrates, plural types of particle groups disposed between the pair of substrates, a first electrode, plural second electrodes, and a third electrode, in succession after a first process, a second process of application of voltages to the display medium to the first through third electrodes such that the first particle group that has passed through the aperture in the third electrode due to the first process moves towards a downstream substrate of the pair of substrates disposed on the downstream side in the passing direction of the first particle group through the aperture, and the second particle group that has not passed through the aperture of the third electrode due to the first process moves towards the substrate on the side facing the downstream substrate.

4 Claims, 14 Drawing Sheets

(56) References Cited

U.S. PATENT DOCUMENTS

| | | | | |
|---|---|---|---|---|
| 2006/0050362 | A1* | 3/2006 | Johnson et al. | 359/296 |
| 2006/0209009 | A1* | 9/2006 | Schlangen et al. | 345/107 |
| 2008/0036731 | A1 | 2/2008 | Shigehiro et al. | |
| 2009/0201569 | A1* | 8/2009 | Akashi et al. | 359/296 |
| 2011/0134506 | A1* | 6/2011 | Hiji et al. | 359/296 |

FOREIGN PATENT DOCUMENTS

| | | | |
|---|---|---|---|
| JP | 2005-501296 | A | 1/2005 |
| JP | 2006-522361 | A | 9/2006 |
| JP | 2006-343458 | A | 12/2006 |
| JP | 2007-249188 | A | 9/2007 |

* cited by examiner

DISPLAY DEVICE COMPRISING A SINGLE, CONTINUOUS DISPLAY ELECTRODE, A PERFORATED INTERMEDIATE ELECTRODE, AND PLURAL PIXEL ELECTRODES

CROSS-REFERENCE TO RELATED APPLICATION

This application claims priority under 35 USC 119 from Japanese Patent Application No. 2009-281708 filed on Dec. 11, 2009.

BACKGROUND

Technical Field

The present invention relates to a display device.

SUMMARY

According to the present invention, there is provided a display device including a voltage application device that performs processes with respect to a display medium including, a pair of substrates, at least one of the substrates being translucent, disposed facing each other and separated from each other, plural types of particle groups disposed between the pair of substrates and moving according to an electric field formed between the substrates, the respective plural types of particle groups having the same polarity and a different color and migration properties, a first electrode disposed at the side of one or other of the pair of substrates, plural second electrodes disposed, at the substrate from the pair of substrate on the side where the first electrode is not disposed, so as to respectively correspond to each pixel of an image subject to display, and a third electrode disposed between the pair of substrates and provided with apertures provided corresponding to each of the plural second electrodes for the particle groups to pass through along the facing direction of the pair of substrates, the voltage application device performing:

a voltage application device that, after performing a first process of application of voltages to the first electrode and the plural second electrodes of voltages such that a first particle group from the plural types of particle groups passes through the aperture in the third electrode, and a second particle group from the plural types of particle groups, with lower migration properties than those of the first particle group, does not pass through the aperture of the third electrode; and in succession after the first process, a second process of application of voltages to the display medium to the first electrode, the plural second electrodes, and the third electrode such that the first particle group that has passed through the aperture in the third electrode due to the first process moves towards a downstream substrate of the pair of substrates disposed on the downstream side in the passing direction of the first particle group through the aperture, and the second particle group that has not passed through the aperture of the third electrode due to the first process moves towards the substrate on the side facing the downstream substrate.

BRIEF DESCRIPTION OF THE DRAWINGS

Exemplary embodiments of the present invention will be described in detail based on the following figures, wherein.

DETAILED DESCRIPTION

Figure 1:
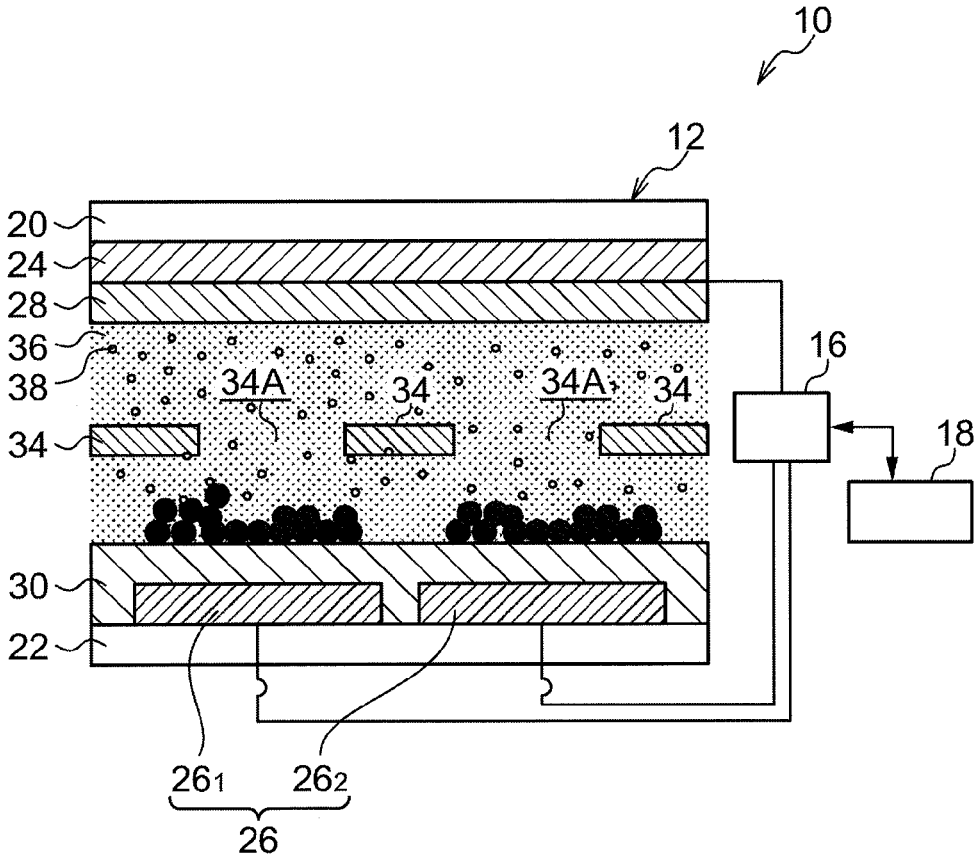
FIG. 1 is a schematic configuration diagram showing an example of a display device according to a first exemplary embodiment.

Explanation follows of present exemplary embodiments, with reference to the drawings. Note that the same reference numeral is appended throughout the drawings to components carrying out roles of similar actions or functions, and duplication of explanation thereof is omitted.

First Exemplary Embodiment

As shown in FIG. 1, a display device 10 according to the present exemplary embodiment is configured including a display medium 12, a voltage application section 16 that applies voltages to the display medium 12, and a control section 18 that controls driving of the voltage application section 16. The control section 18 is connected to the voltage application section 16 in such a manner as to be able to send and receive signals to and from the voltage application section 16.

The control section 18 is, for example, configured including a Central Processor Unit (CPU) that controls device operation overall, a Random Access Memory (RAM) that temporally stores various data, and a Read Only Memory (ROM) on which various programs are stored in advance, including a control program for controlling the device overall, and a program in which processing routines are expressed.

Note that the display device 10 corresponds to the display device of the present invention. Furthermore, the voltage application section 16 and the control section 18 correspond to the voltage application device in the display device of the present invention.

The display medium 12 includes a translucent display substrate 20 (having a transmissivity to visible light of 70% or greater), forming an image display face, and a back substrate 22, disposed facing the display substrate 20 with a separation therebetween. A dispersion medium 36 is filled between the substrates of the display substrate 20 and the back substrate 22. Particle groups 40 are dispersed in the dispersion medium 36 and move (migrate) between the substrates according to an electric field formed between the substrates of the display substrate 20 and the back substrate 22. A dye, a pigment, colored particles, or the like, for example, are added to and color the dispersion medium 36, such that the particle groups 40 are visible when they have moved to the display substrate 20 side, and are concealed when they have moved to the back substrate 22 side. While an example is given of coloration by white colored particles 38 in the present exemplary embodiment, there is no particular limitation thereto, and a hue less color, such as white, black or the like, or a color having hue, such as red, green, blue or the like, may be employed as the color for coloration.

Materials such as, for example, glass and plastics are applicable for the display substrate 20. Examples of applicable glass include, for example, soda-lime glass, borosilicate glass and the like. Examples of applicable plastics include a polycarbonate resin, an acrylic resin, a polyimide resin, a polyester resins such as polyethylene terephthalate or the like, an epoxy resin, a polyethersulfone resin, and the like. Furthermore, since the back substrate 22 does not need to be translucent, application may be made thereto of, for example, an insulation layer, for example a resin or the like, covered onto a stainless steel plate or the like.

The display substrate 20 is provided in sequence with a display electrode 24 and an insulation layer 28. The back substrate 22 is provided in sequence with plural pixel electrodes 26 and an insulation layer 30.

Figure 2:
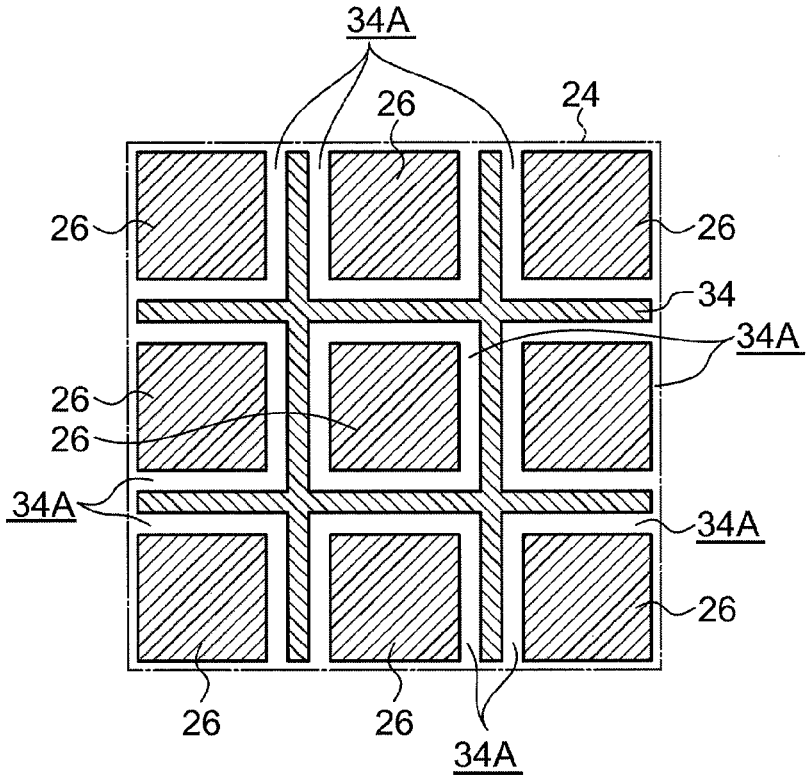
FIG. 2 is a schematic configuration diagram, schematically showing a configuration of electrodes in a display medium of the display device shown in FIG. 1.

In the present exemplary embodiment, the display electrode 24 is provided in a layer shape along the plate face of the display substrate 20, as shown in FIG. 2, forming a so-called planar electrode. The display electrode 24 is electrically connected to the voltage application section 16. Consequently, the display electrode 24 is configured as a common electrode applied with the same voltage over the entire region of the display electrode 24 by application of a voltage from the voltage application section 16.

The plural pixel electrodes 26 are in an arrayed state in both a column and a row direction along the face direction of the back substrate 22, with spacings therebetween (see FIG. 2). Note that FIG. 1 is simplified for explanatory purposes, and only two pixel electrodes 26, the pixel electrode $\mathbf{26}_1$ and pixel electrode $\mathbf{26}_2$, are illustrated. When referring in general to plural pixel electrodes 26, including the pixel electrode $\mathbf{26}_1$ and the pixel electrode $\mathbf{26}_2$, reference will be made simply to pixel electrodes 26. The plural pixel electrodes 26 are each independently electrically connected to the voltage application section 16, with configuration made such that voltages are independently applied to the pixel electrodes 26 from the voltage application section 16.

Note that while explanation is given in the present exemplary embodiment of a case where each of the plural pixel electrodes 26 are in a one-to-one correspondence relationship to each of the pixels of an image for display on the display medium 12, configuration may also be made with plural of the pixel electrodes 26 provided to correspond to a single pixel.

Note also that while explanation is given in the present exemplary embodiment of a case where all of the display electrode 24, the plural pixel electrodes 26, and an intermediate electrode 34, described below, are electrically connected to the voltage application section 16, the display electrode 24 may be in a grounded state.

The display electrode 24, the pixel electrodes 26 and the intermediate electrode 34 employ: oxides, for example, oxides of indium, tin, zinc, antimony, and the like; composite oxides, such as, for example, ITO and the like; metals, such as, for example, gold, silver, copper, nickel and the like; and organic materials, such as, for example, a polypyrrole, a polythiophene and the like.

The display electrode 24 may be embedded in the display substrate 20, and, in a similar manner, the pixel electrodes 26 may be embedded in the back substrate 22. In such cases, the materials of the display substrate 20 and the back substrate 22 need to be selected according to the composition and the like of the particle groups 40, such that there is no affect on the electrostatic properties of the particle groups 40.

The insulation layer 28 and the insulation layer 30 are insulating layers (having a volume resistivity of $10^{11}$ Ω·cm or greater, this definition of insulating also applies below). The insulation layer 28 is provided in a layer shape so as to be layered on the display electrode 24 that is provided on the display substrate 20. The insulation layer 30 is a layer of a film shape provided on the plural pixel electrodes 26 provided on the back substrate 22. Examples of materials for configuring the insulation layer 28 and the insulation layer 30 include, for example: resins such as a polycarbonate, a polyester, a polystyrene, a polyimide, an epoxy, a polyurethane, a polyamide, a polyvinyl alcohol, polybutadiene, polymethyl methacrylate, polyacrylate, a copolymerized nylon, a silicone resin, a fluororesin or the like; metal oxides, such as silicon dioxide, alumina, tantalum pentoxide, barium titanate, strontium titanate, lead titanate, and the like; and metal nitrides, such as silicon nitride and the like.

The intermediate electrode 34 is provided between the substrates of the display substrate 20 and the back substrate 22. There are plural apertures 34A provided in the intermediate electrode 34 so as to correspond to each of the plural pixel electrodes 26. The apertures 34A allow the particle groups 40 to pass through along the facing direction of the display substrate 20 and the back substrate 22. The intermediate electrode 34 is also electrically connected to the voltage application section 16. The intermediate electrode 34 is configured as a common electrode such that the same voltage is applied to the entire region of the intermediate electrode 34 through application of a voltage from the voltage application section 16.

Figure 13A:
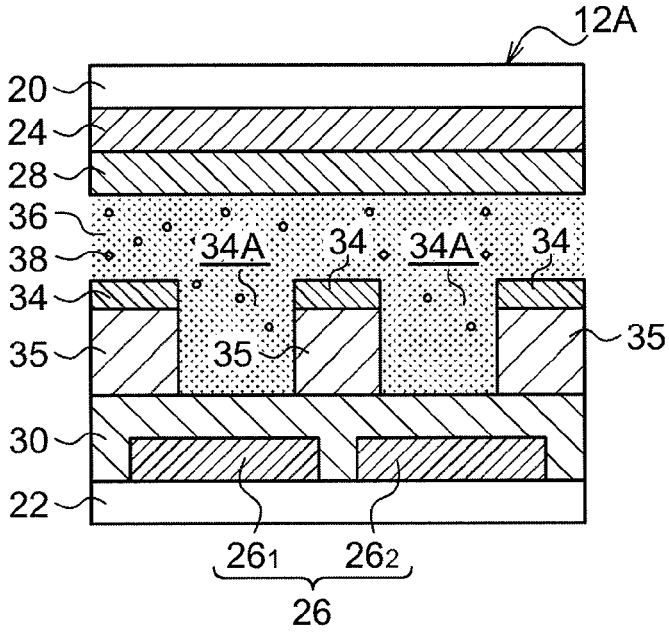
FIG. 13A to FIG. 13C are schematic configuration diagrams showing examples of display devices according to the first exemplary embodiment, in different modes to that of FIG. 1.
Figure 13B:
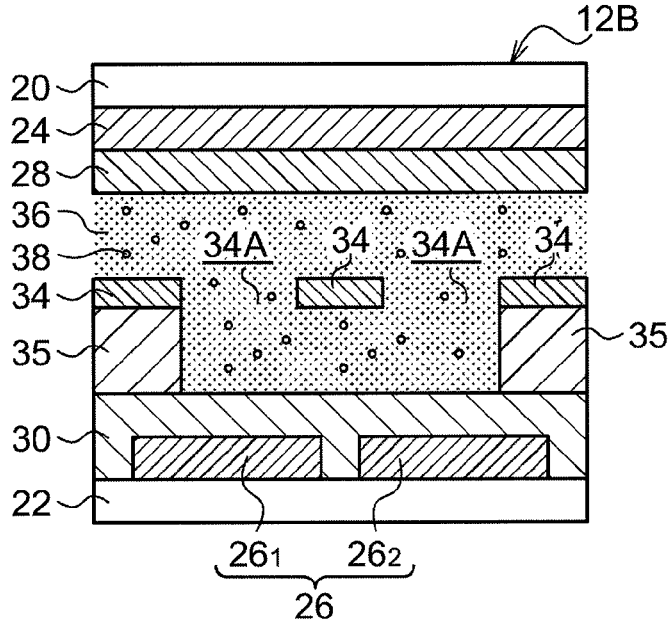
Figure 13C:
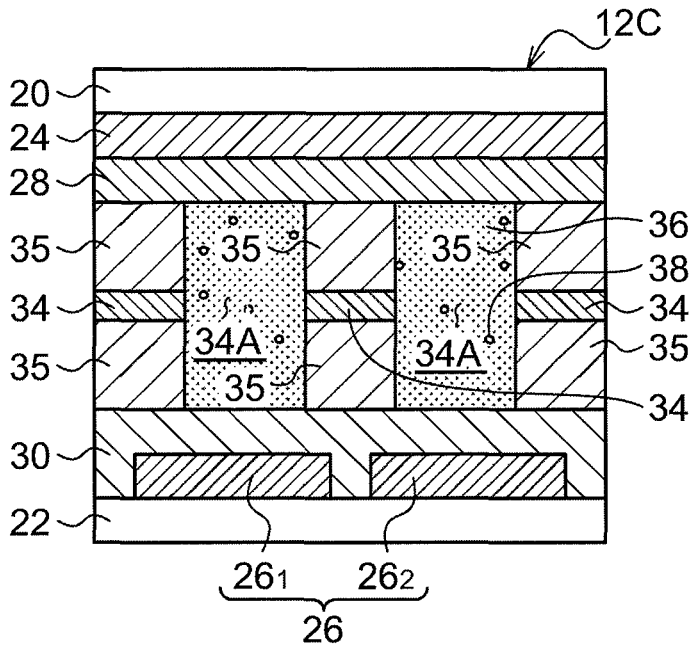

Note that while explanation is given in the present exemplary embodiment of a case where the intermediate electrode 34 is configured in a mesh shape, held at the edges thereof by a support member of the display medium 12, omitted in the drawings, and disposed between the display substrate 20 and the back substrate 22, there is no limitation to such an embodiment. For example, a support body 35 may be provided either between the intermediate electrode 34 and the insulation layer 28, or between the intermediate electrode 34 and the insulation layer 30, in order to dispose the intermediate electrode 34 between the display substrate 20 and the back substrate 22. In such cases, the support body 35 may be provided over the entire face between the intermediate electrode 34 and the insulation layer 30 (FIG. 13A), or may be locally provided (FIG. 13B). In a similar manner, the support body 35 may also be provided between the intermediate electrode 34 and the insulation layer 28 (FIG. 13C).

Dielectric materials are employed as materials for configuring the support body 35, with examples thereof including resins such as, for example, a polyacrylate, a polymethacrylate, a polyester, an epoxy, a polyurethane, a polyimide, and the like.

In the present exemplary embodiment, the intermediate electrode 34 is configured with the apertures 34A as shown in FIG. 2, for the particle groups 40 to pass through in regions corresponding to each of the plural pixel electrodes 26. At least one of the individual apertures 34A is provided for each of the individual pixel electrodes 26, and provision may be made of plural individual apertures 34A for each pixel electrode 26. The apertures 34A should be provided in locations corresponding to each of the respective pixel electrodes 26, so as to form apertures letting the particle groups 40, moving towards the display electrode 24 side from each of the respective plural pixel electrodes 26, pass through. In the present exemplary embodiment, as shown in FIG. 2, explanation follows of a case in which the apertures 34A corresponding to each of the respective plural pixel electrodes 26 are formed as holes of rectangular shape, similar to the shape of the pixel electrodes 26. Therefore, explanation is of the intermediate electrode 34 configured in a lattice shape by the plural apertures 34A.

Figure 3:
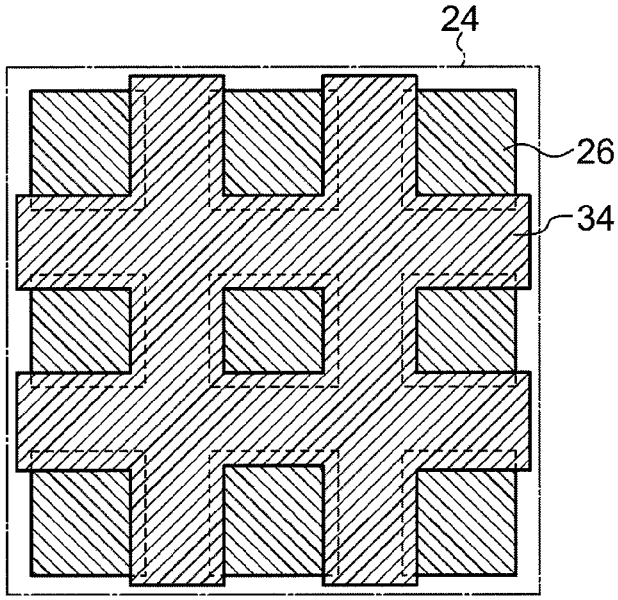
FIG. 3 is a schematic configuration diagram, schematically showing a configuration electrodes in a display medium of the display device shown in FIG. 1.

Note that the intermediate electrode 34 is configured as a common electrode, with apertures 34A provided at positions corresponding to each of the respective plural pixel electrodes 26, for the particle groups 40 to pass through along the facing direction of the display substrate 20 and the back substrate 22. Therefore, the intermediate electrode 34 may be configured with the apertures 34A provided as holes, spaces, or the like in positions corresponding to each of the respective pixel electrodes 26, such that, as shown in FIG. 2, they do not overlap with each of the respective plural pixel electrodes 26 when the display medium 12 is viewed from the display substrate 20 side (such that the entire region of each of the respective pixel electrodes 26 can be seen from the display substrate 20 side). Alternatively, the intermediate electrode 34 may also be configured, as shown in FIG. 3, with the apertures 34A provided as holes, spaces, or the like in positions corresponding to each of the respective pixel electrodes 26, such that they overlap with each of the respective plural pixel electrodes 26 when the display medium 12 is viewed from the display substrate 20 side (such that only a portion of the entire region of each of the respective pixel electrodes 26 can be seen from the display substrate 20 side).

Furthermore, while explanation is given in the present exemplary embodiment of a case where the shape of the apertures 34A is a rectangular shape, any shape may be employed as long as an aperture is formed for the particle groups 40 to pass through. The size of the apertures 34A is in the range of 1/10 to 10 times the separation distance between the display substrate 20 and the back substrate 22, and preferably in the range of 1/3 to 3 times the separation distance. Reference here to the size of the apertures 34A means the diameter when the shape of the opening is circular, and either the short or the long side dimension when the opening is a rectangular shape. When the size is greater than this range, there are occasions when the potential barrier in the vicinity of the center of the apertures 34A is insufficient, and execution of a second process is difficult. However, if the size is smaller than this range then there are cases where it is difficult to control whether or not the particle groups 40 pass through from the display substrate 20 side towards the back substrate 22 side by modifying the electrical potential of the pixel electrode 26.

The proportional surface area of the apertures 34A when viewed from the display substrate 20 side is 10% or greater, and preferably 40% or greater. If the surface area is lower than this, then, as well as display unevenness readily occurring from reflection of the opening pattern of the intermediate electrode 34, passing/not passing of the particle groups 40 is sometimes insufficient, and sometimes there is a length duration until passing is complete.

The position of the intermediate electrode 34 between the substrates of the display substrate 20 and the back substrate 22 may be any position between the electrodes, as long as there is no contact with both the display electrode 24 provided to the display substrate 20 and the pixel electrode 26 provided at the back substrate 22 side. Therefore, the intermediate electrode 34 may be provided positioned exactly at the central position between the display electrode 24 and the pixel electrode 26, or may be an embodiment in which the intermediate electrode 34 is provided nearer to the display electrode 24 side than the central position, or nearer to the pixel electrode 26 side than the central position.

There are also no particular limitations to the color of the intermediate electrode 34, however, by employing a material that reflects light, such as, for example, a white colored, a mirrored surface, or the like, the reflectivity can be increased when the particle groups 40 have moved to the display electrode 24 side. Alternatively, by employing a material with light blocking ability, such as, for example, a black colored material or the like, the concealing ability of the dispersion medium 36 can be enhanced. Furthermore, by employing a transparent material, unevenness in display caused by the intermediate electrode 34 can be made less noticeable.

The intermediate electrode 34 may also be an electrode having different optical reflection properties to those of the particle groups 40. Note that by "the intermediate electrode 34 having different optical reflection properties to those of the particle groups 40" means that when visual comparison observations are made between the dispersion medium 36 in which only the particle groups 40 are dispersed, and the dispersion medium 36 just provided with the intermediate electrode 34, there is a discernable difference therebetween in hue, brightness, vividness, or the like. By configuration with the intermediate electrode 34 to have different optical reflection properties to those of the particle groups 40, multi-colored display is also executable with the color of the intermediate electrode 34.

Examples of the dispersion medium 36 filled between the display substrate 20 and the back substrate 22 include insulating liquids. Examples of the dispersion medium 36 include: hexane, cyclohexane, toluene, xylene, decane, hexadecane, kerosene, a paraffin, an isoparaffin, a silicone oil, dichloroethylene, trichloroethylene, perchlorethylene, high grade petroleum, benzine, diisopropylnaphthalene, an olive oil, trichlorotrifluoroethane, tetrachloroethane, dibromotetrafluoroethane, and the like; and mixtures thereof.

The white colored particles 38 dispersed in the dispersion medium 36 are white colored particles that do not move even when an electric field is formed between the substrates. A high refraction material is employed as a composition material of the white colored particles 38, for example, organic pigments such as, for example, melamine and vinyl naphthalene compounds, and inorganic pigments, such as, for example, titanium oxide and the like. The volume average particle size of the white colored particles 38 is, for example, 0.01 μm to 20 μm, or the like. Explanation is given in the present exemplary embodiment of a case where the white colored particles 38 are of a white color, however there is no limitation to the color white as long as they are particles having optical reflection properties that are different from that of the electrophoretically moving particle groups 40. Reference here to the "the white colored particles 38 having optical reflection properties that are different from that of the particle groups 40" means that when visual comparison observations are made of the dispersion medium 36 in which only the particle groups 40 are dispersed, and the dispersion medium 36 in which only the white colored particles 38 are dispersed, there is a discernable difference therebetween in hue, brightness, vividness or the like.

The particle groups 40 are configured from plural particles that move according to an electric field formed between the display substrate 20 and the back substrate 22 (sometimes referred to below simply as "between the substrates"). More precisely, the particle groups 40 move between the substrates according to their composition when an electric field of a given intensity is formed between the substrates. Namely, the particle groups 40 move between the substrates according to the migration properties of the particle groups 40, by applying a voltage between the substrates such that an electrical potential is achieved to form an electric field of sufficient intensity to move the particle groups 40.

Reference here to "electric field intensity" refers to the difference in electrical potential per unit of separation distance (V/m) (referred to below simply as "potential difference").

Reference to "migration properties" here indicates at least one or other of the migration speed after the particle groups 40 have started to move between the substrates, and/or the voltage value to start the particle groups 40 moving between the substrates (referred to below as the voltage threshold value).

The electric field intensity and the migration properties for starting movement of the particle groups 40 depends, for example, on the surface flow resistance to the dispersion medium 36, the average charge amount, the particle size, the shape factor, and the like of each of the particles configuring the particle groups 40.

Examples of particles for employment as these particle groups 40 include: metallic oxide particles, such as, for example, alumina, titanium oxide, and the like; thermoplastic or thermosetting resin particles; such resin particles with a colorant adhered to the surface thereof; and particles of thermoplastic or thermosetting resin containing a colorant therein.

Examples of thermoplastic resins for the preparation of the particle groups 40 include, for example, homopolymers and copolymers of: styrenes, such as, for example, styrene and chlorostyrene; monoolefines such as, for example, ethylene, propylene, butylene and isoprene; vinyl esters such as, for example, vinyl acetate, vinyl propionate, vinyl benzoate and vinyl butyrate; esters of α-methylene aliphatic monocarboxylic acid, such as, for example, methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate; vinyl ethers, such as, for example, vinylmethyl ether, vinylethyl ether, and vinylbutyl ether; vinyl ketones, such as, for example, vinyl methyl ketone, vinyl hexyl ketone, and vinyl isopropenyl ketone; and the like.

Examples of thermosetting resins for the preparation of the particle groups 40 include: cross-linking resins, such as, for example, cross-linking copolymers which use divinylbenzene as a principal component, and cross-linking polymethylmethacrylate; a phenol resin; a urea resin; a melamine resin; a polyester resin; silicone resin; and the like. In particular, typical binder resins that can be used include polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene, polypropylene, a polyester, a polyurethane, an epoxy resin, a silicone resin, a polyamide, a modified rosin, a paraffin wax, and the like.

Organic and inorganic pigments and oil soluble dyes may be used as colorants. Typical examples thereof include: magnetic powders, such as, for example, magnetite and ferrite; carbon black; titanium oxide; magnesium oxide; zinc oxide; copper phthalocyanine cyan coloring materials; azo yellow coloring materials, azo magenta coloring materials; quinacridone magenta coloring materials; known colorants for red color materials, green color materials, and blue color materials; and the like. Specifically, the following are typical examples that can be used: aniline blue, chalco oil blue, chrome yellow, ultra marine blue, DuPont oil red, quinoline yellow, methylene blue chloride, phthalocyanine blue, malachite green oxalate, lamp black, rose bengal, C.I. pigment red 48:1, C.I. pigment red 122, C.I. pigment red 57:1, C.I. pigment yellow 97, C.I. pigment blue 15:1, C.I. pigment blue 15:3 and the like.

Charge control agents may be mixed into resin included in the particle groups 40, as required. Known electrophotographic toner materials can be used as such charge control agents.

There is no particular limitation on the contained amount (% by weight) of the particle groups 40 included in the display medium 12 as long as it is a concentration at which the desired hue can be obtained, however generally the contained amount is from 0.01% by weight to 50% by weight.

The display medium 12 of the present exemplary embodiment, configured as described above, may be employed, for example, as a re-writable notice board that holds images, a circular notice board, an electronic blackboard, an advertising hording, a sign, a flashing indicator, electronic paper, an electronic newspaper, an electronic book, a document sheet used in conjunction with a copier, or the like.

Explanation is given in the present exemplary embodiment of a case where the display electrode 24 is provided on the display substrate 20 side, acting as the display face, and the plural pixel electrodes 26 are provided on the back substrate 22 side, however configuration may be made with the plural pixel electrodes 26 provided on the display substrate 20 side and the display electrode 24 provided on the back substrate 22 side. Namely, configuration of the display medium 12 may be made with the plural pixel electrodes 26 provided on the display substrate 20 side, acting as the display face.

Configuration may also be made with an active element, such as, for example, a thin film transistor, a thin film diode, a metal-insulator-metal element or the like provided to each of the plural pixel electrodes 26.

In the display medium 12 of the present exemplary embodiment, as described above, the particle groups 40 are moved according to the electric field formed between the substrates. Consequently, in the display medium 12, when moving the particle groups 40 of a region corresponding to a particular pixel between the substrates, of the back substrate 22 provided with the plural pixel electrodes 26 and the display substrate 20 provided with the display electrode 24, the particle groups 40 of the region corresponding to the particular pixel are moved by applying a voltage, and generating a potential difference, between the common electrode of the display electrode 24 and the pixel electrode 26, from the plural pixel electrodes 26, provided in the position corresponding to the pixel where the particle groups 40 are to be moved. By moving the particle groups 40 to the display substrate 20 side, out of the total region of the display substrate 20 of the display medium 12, the regions where the particle groups 40 arrive at the display substrate 20 display the color due to the particle groups 40. Out of the total region of the display substrate 20 of the display medium 12, the regions where the particle groups 40 are positioned to the back substrate 22 side display the color due to the white colored particles 38.

Conventionally, there are occasions where the particle groups 40 do not sufficiently pushed out towards the display substrate 20 side, or towards the pixel electrode 26 side, with there being particles present floating around in between. Therefore, occasions arise where a clear color separation cannot be obtained when a separate different color is displayed from a given color that is currently being displayed.

In order to address this issue, the display device 10 of the present exemplary embodiment, when moving the particle groups 40 from the pixel electrode 26 side to the display electrode 24 side, or from the display electrode 24 side to the pixel electrode 26 side, performs a first process, by controlling the voltage application section 16 with the control section 18, and then in succession after the first process, moves the particle groups 40 to the side of one of other of substrates by performing a second process.

Note that the first process and the second process are performed by application of voltages from the voltage application section 16 to the display electrode 24, the intermediate electrode 34 and the pixel electrodes 26. The voltage application section 16 is driven by control of the control section 18.

Reference to the first process indicates the application of voltages to the display electrode 24, the intermediate electrode 34 and the plural pixel electrodes 26 such that, out of the particle groups 40 encapsulated in the display medium 12, the particle groups 40 positioned at regions corresponding to the pixels where the particle groups 40 are to be moved pass through the apertures 34A of the intermediate electrode 34, and the particle groups 40 positioned at regions corresponding to the pixels where the particle groups 40 are not to be moved do not pass through the apertures 34A of the intermediate electrode 34.

More precisely, in the first process, voltages are applied to the display electrode 24, the intermediate electrode 34 and the plural pixel electrodes 26 such that the potential difference between the display electrode 24, the intermediate electrode 34 and the pixel electrodes 26, from the plural pixel electrodes 26, provided at positions corresponding to the pixels where the particle groups 40 are to be moved, is made a potential difference such that the particle groups 40 pass through the apertures 34A of the intermediate electrode 34 from one substrate side to the other substrate side, and the potential difference between the display electrode 24, the intermediate electrode 34 and the pixel electrodes 26, from the plural pixel electrodes 26, provided at positions corresponding to the pixels other than where the particle groups 40 are to be moved, is made a potential difference such that the particle groups 40 do not pass through the apertures 34A of the intermediate electrode 34.

The above second process is a process performed in succession after the above first process. The second process indicates the application of voltages to the display electrode 24, the intermediate electrode 34 and the plural pixel electrodes 26, to move the particle groups 40 that have passed through the apertures 34A of the intermediate electrode 34 due to the first process, from the particle groups 40 dispersed in the display medium 12, towards a downstream substrate side positioned at the downstream side in the particle groups 40 passing direction (the side of one or other of the display substrate 20 or the back substrate 22), and to move the particle groups 40 that have not passed through the apertures 34A of the intermediate electrode 34, due to the first process, towards the side of the substrate that faces the downstream substrate (the other side of the display substrate 20 or the back substrate 22).

More precisely, in the above second process, voltages are applied to the display electrode 24, the intermediate electrode 34 and the plural pixel electrodes 26 such that the potential difference between the display electrode 24, the intermediate electrode 34 and the plural pixel electrodes 26 is made a potential difference such that, out of the particle groups 40 encapsulated in the display medium 12, the particle groups 40 that have passed through the apertures 34A of the intermediate electrode 34 due to the first process, are moved towards the downstream substrate side positioned at the downstream side in the passing direction (the display substrate 20 side), and the particle groups 40 that have not passed through the apertures 34A of the intermediate electrode 34 are moved towards the substrate side facing the downstream substrate (the back substrate 22 side).

Figure 4A:
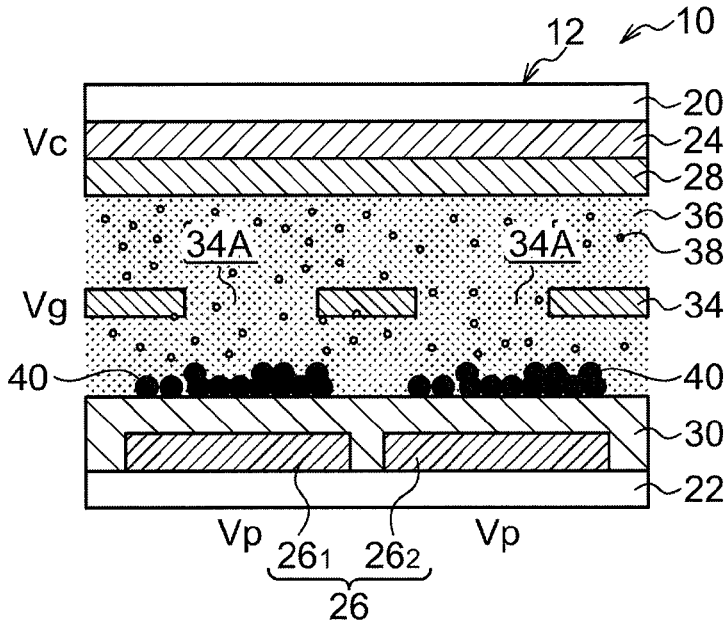
FIG. 4A to FIG. 4C are schematic diagrams showing operation of a display device of the first exemplary embodiment.

For example, from a state in which all of the particle groups 40 are positioned at the back substrate 22 side, as shown in FIG. 4A, only the particle groups 40 present at regions corresponding to the pixel electrode $\mathbf{26}_1$, from the plural pixel electrodes 26 (the pixel electrode $\mathbf{26}_1$, and the pixel electrode $\mathbf{26}_2$), are moved to the display substrate 20 side, thereby displaying an image. Namely, from the plural pixel electrodes 26, the pixel electrode $\mathbf{26}_1$ is one of the pixel electrode(s) 26 provided at positions corresponding to the pixels where the particle groups 40 are to be moved between the substrates, and the pixel electrode $\mathbf{26}_2$ is one of the pixel electrode(s) 26 provided at positions corresponding to the pixels other than where the particle groups 40 are to be moved.

Figure 4B:
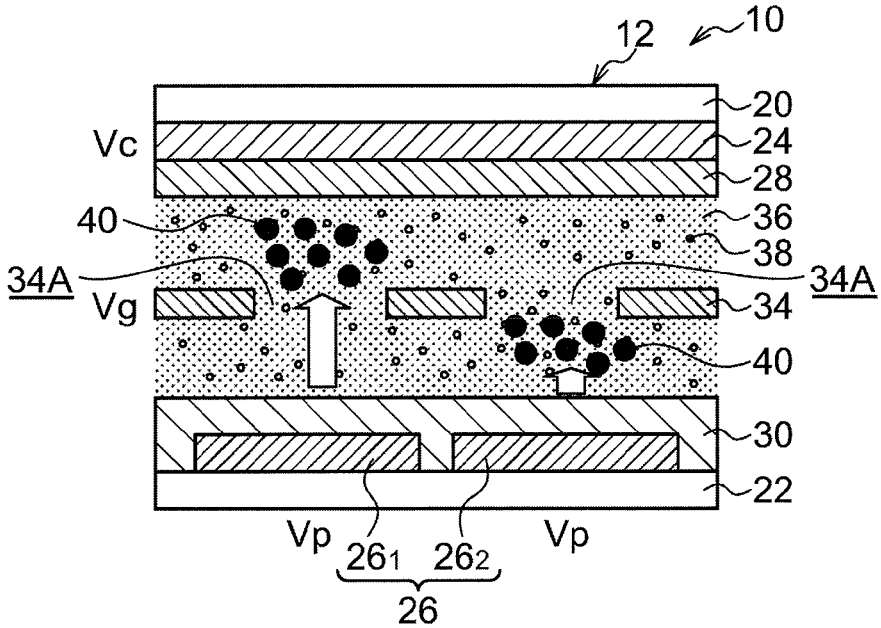

In this case, by performing the above first process, as shown in FIG. 4B, from the particle groups 40 encapsulated in the display medium 12, the particle groups 40 positioned at the region corresponding to the pixel electrode $\mathbf{26}_1$ pass through the apertures 34A of the intermediate electrode 34, and the particle groups 40 positioned in the region corresponding to the pixel electrode $\mathbf{26}_2$ do not pass through the apertures 34A of the intermediate electrode 34.

Figure 4C:
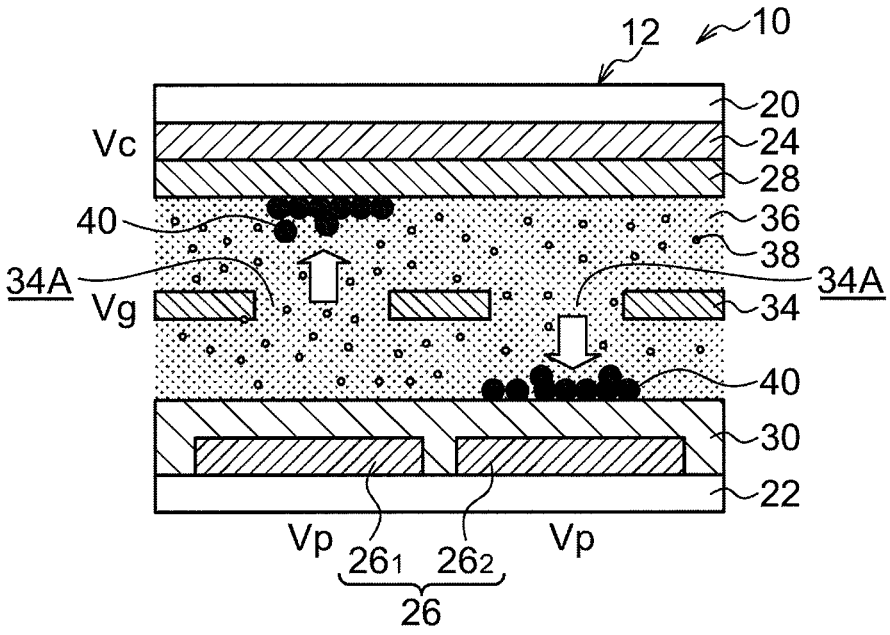

Then, by performing the above second process, as shown in FIG. 4C, the particle groups 40 that have passed through the apertures 34A due to the first process are moved towards the display substrate 20 side provided with the display electrode 24, and the particle groups 40 that did not pass through the apertures 34A due to the above first process are moved towards the back substrate 22 provided with the pixel electrode $\mathbf{26}_2$.

Consequently, in the display device 10 of the present exemplary embodiment, when moving the particle groups 40 of a region corresponding to particular pixel(s) towards one of the facing substrate sides, movement towards that substrate side is suppressed for the particle groups 40 situated in regions corresponding to pixels other than the pixels where the particle groups 40 are to be moved, suppressing movement of particle groups to regions corresponding to adjacent pixels and suppressing interference from occurring, and this is thought to lead to higher image quality.

Figure 5A:
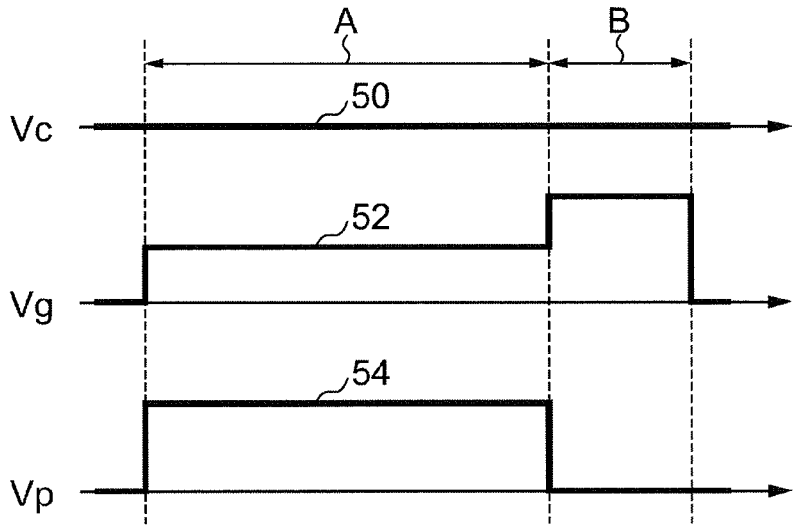
FIG. 5A is a schematic diagram showing voltages applied in a first process when a particle group is moved from the pixel electrode side to the display electrode side.
Figure 5B:
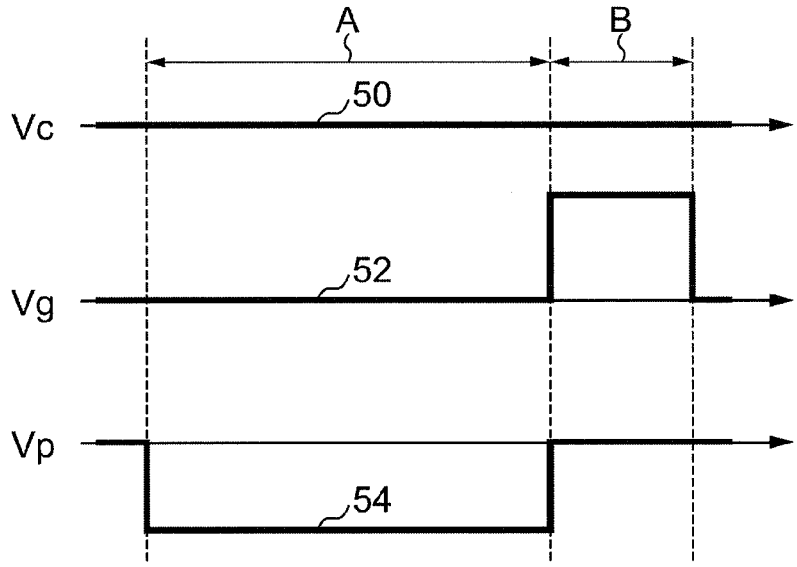
FIG. 5B is a schematic diagram showing voltages applied in a first process when a particle group is moved from the display electrode side to the pixel electrode side.

Examples of voltages applied to the display electrode 24, the intermediate electrode 34 and the plural pixel electrodes 26 during the above first process and second process are shown in FIG. 5A and FIG. 5B.

Note that for ease of explanation in FIG. 5A and FIG. 5B, explanation is given of a case where a voltage Vc of 0V is applied to the display electrode 24, or the display electrode 24 is grounded. Explanation is also given of a case where the particle groups 40 are charged with a positive polarity. In a similar manner to in FIG. 4A to FIG. 4C, from the plural pixel electrodes 26, the pixel electrode $\mathbf{26}_1$ is one of the pixel electrode(s) 26 provided at positions corresponding to the pixels where the particle groups 40 are to be moved between the substrates, and the pixel electrode $\mathbf{26}_2$ is one of the pixel electrode(s) 26 corresponding to the pixels other than the pixels where the particle groups 40 are to be moved.

FIG. 5A shows an example of voltages applied to the display electrode 24, the intermediate electrode 34, and the pixel electrode $\mathbf{26}_1$ provided at a position corresponding to a pixel where the particle groups 40 are to be moved, when the particle groups 40 are moved from the pixel electrodes 26 side to the display electrode 24 side by the first process and the second process.

When moving the particle groups 40 from the pixel electrode 26 side to the display electrode 24 side, as shown in FIG. 5A, for a period of time A during which the first process is performed, a voltage Vc of 0V is applied to the display electrode 24 and a voltage Vp is applied to the pixel electrode $\mathbf{26}_1$ to give a potential difference to the display electrode 24 that moves the particle groups 40 from the pixel electrode $\mathbf{26}_1$ side (the back substrate 22 side) towards the display electrode 24 side (display substrate 20 side). A voltage Vg is applied to the intermediate electrode 34 so as to give a potential difference that is a potential difference between the display electrode 24 and the pixel electrode $\mathbf{26}_1$ that moves the particle groups 40 from the pixel electrode $\mathbf{26}_1$ side (back substrate 22 side) through the apertures 34A towards the display electrode 24 side (display substrate 20 side).

Note that, while not shown in the drawings, a voltage may be applied to the pixel electrode $\mathbf{26}_2$ that is one of the pixel electrodes 26 corresponding to a pixel other than a pixel where the particle groups 40 are to be moved, such that the potential difference between the intermediate electrode 34 and the display electrode 24 is a potential difference where the particle groups 40 do not pass through the apertures 34A of the intermediate electrode 34. For example, a voltage of 0V may be applied to the pixel electrode $\mathbf{26}_2$.

Then, for a period of time B for performing the second process successively after the first process, the voltage Vc of 0V continues to be applied to the display electrode 24, and a voltage Vg is applied to the intermediate electrode 34 such that: the potential difference between the intermediate electrode 34 and the pixel electrode $\mathbf{26}_1$ is a potential difference that moves the particle groups 40 that have passed through the apertures 34A of the intermediate electrode 34 towards the display electrode 24 side (the display substrate 20 side); and the potential difference between the intermediate electrode 34 and the pixel electrode $\mathbf{26}_2$, corresponding to a pixel other than a pixel where the particle groups 40 are to be moved, moves the particle groups 40 that have not passed through the apertures 34A of the intermediate electrode 34 towards the pixel electrode 26 side (the back substrate 22 side).

Note that when moving the particle groups 40 from the pixel electrode 26 side towards the display electrode 24 side, during the period of time A for performing the first process the relationship between a potential difference P, between the pixel electrode $\mathbf{26}_1$, provided at a position from the plural pixel electrodes 26 corresponding to a pixel where the particle groups 40 are to be moved, and the display electrode 24, and a potential difference G between the pixel electrode $\mathbf{26}_1$ and the intermediate electrode 34 may satisfy the following Formula (1).

$$P/2 \leq G \leq P \qquad \text{Formula (1)}$$

By satisfying the relationship of Formula (1), when, during the first process, the particle groups 40 are being moved from the plural pixel electrodes 26 side towards the display electrode 24 so as to achieve a state in which they have passed through the apertures 34A, the particle groups 40 are not readily trapped in the apertures 34A of the intermediate electrode 34, and a potential barrier due to the intermediate electrode 34 is suppressed from occurring. Consequently, it is thought that the particle groups 40 are efficiently moved from the pixel electrode 26 side towards the display electrode 24 side, passing through the apertures 34A of the intermediate electrode 34.

Figure 6:
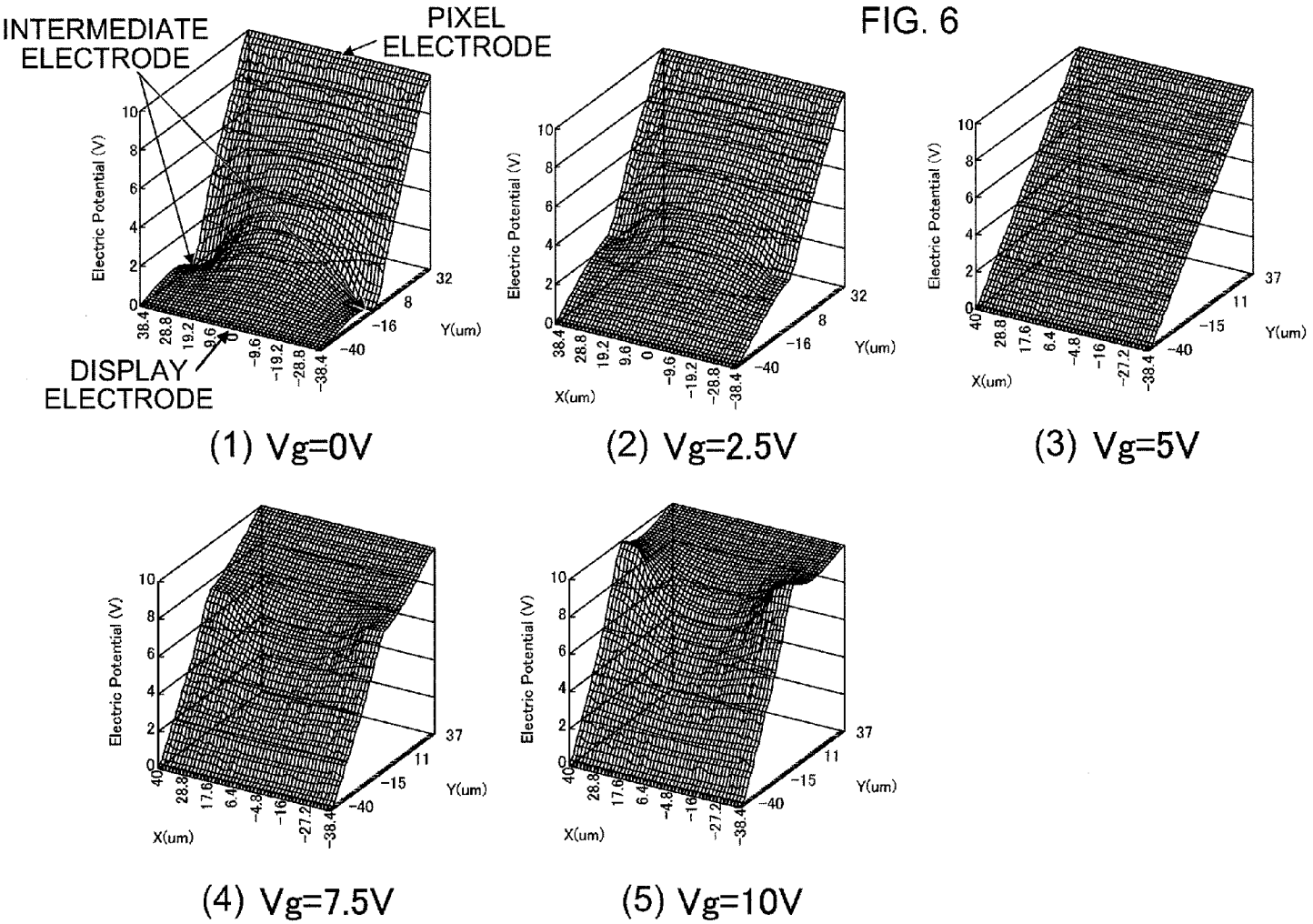
FIG. 6(1) to (5) are schematic diagrams showing field simulation results when voltages are applied to a display electrode, a pixel electrode and an intermediate electrode.

FIG. 6 shows electric field simulation results when voltages are applied to the display electrode 24, the pixel electrodes 26 and the intermediate electrode 34.

In FIG. 6, an electrode of 80 μm×80 μm, with a thickness of 3 μm, is prepared for each of the display electrode 24 and the pixel electrode 26, with the display electrode 24 and the pixel electrode 26 disposed facing each other with a separation of 80 μm therebetween. An electrode of thickness 3 μm, provided with a square hole (aperture 34A) of 60 μm×60 μm positioned so as to correspond to the pixel electrode 26, is prepared as the intermediate electrode 34. A test display medium A is prepared by placing the intermediate electrode 34 at a position central between the display electrode 24 and the pixel electrode 26 (the intermediate electrode 34 having a separation distance to the display electrode 24 and a separation distance to the pixel electrode 26 of 37 μm, respectively). FIG. 6(1) to FIG. 6(5) show the electrical potential surface from respective electric field simulations when a voltage of 0V is applied to the display electrode 24 of the test display medium A, a voltage of 10V is applied to the pixel electrode 26, and respective voltages of 0V, 2.5V, 5V, 7.5V, and 10V are applied to the intermediate electrode 34.

Note that FIG. 6(1), FIG. 6(2), and FIG. 6(3) show the electrical potential surface from electric field simulations when, respectively, a voltage of 0V is applied to the intermediate electrode 34, a voltage of 2.5V is applied to the intermediate electrode 34, and a voltage of 5V is applied to the intermediate electrode 34. FIG. 6(4) and FIG. 6(5) show simulation results of the electrical potential surface when a voltage of 7.5V is applied to the intermediate electrode 34, and a voltage of 10V is applied to the intermediate electrode 34.

As shown in FIG. 6, it can be seen that a hollow occurs in the electrical potential surface in a region equivalent to the position of the intermediate electrode 34 when the voltage applied to the intermediate electrode 34 is a value ½ or less than the voltage of 10V applied to the pixel electrode 26, as in FIG. 6(1) and FIG. 6(2). However, it can be seen that no hollow occurs in the electrical potential surface when the voltage applied to the intermediate electrode 34 exceeds 5V, a value that is ½ of the voltage of 10V applied to the pixel electrode 26, as shown in FIG. 6(3) to FIG. 6(5).

Since the particle groups 40 move from high to low electrical potentials along the electrical potential surface, the particle groups 40 moving from the pixel electrode 26 side to the display substrate 20 side sometimes get trapped in the apertures 34A of the intermediate electrode 34 corresponding to the hollows of the electrical potential surface when the voltage applied to the intermediate electrode 34 is a value ½ or less than the voltage of 10V applied to the pixel electrode 26. However, when the voltage applied to the intermediate electrode 34 exceeds a value of ½ of the voltage of 10V applied to the pixel electrode 26, the particle groups 40 moving from the pixel electrode 26 side to the display substrate 20 side do not get trapped in the apertures 34A of the intermediate electrode 34.

Consequently, as shown in above Formula (1), in order to achieve conditions in which the particle groups 40 pass from the plural pixel electrode 26 side towards the display electrode 24 side through the apertures 34A, the relationship in the first process of the potential difference P between the pixel electrode $\mathbf{26}_1$, from the plural pixel electrodes 26, provided at a position corresponding to one of the pixels where the particle groups 40 are to be moved, and the display electrode 24, and the potential difference G between the pixel electrode $\mathbf{26}_1$ and the intermediate electrode 34, preferably satisfies the relationship $P/2 \leq G$ of Formula (1).

Figure 7:
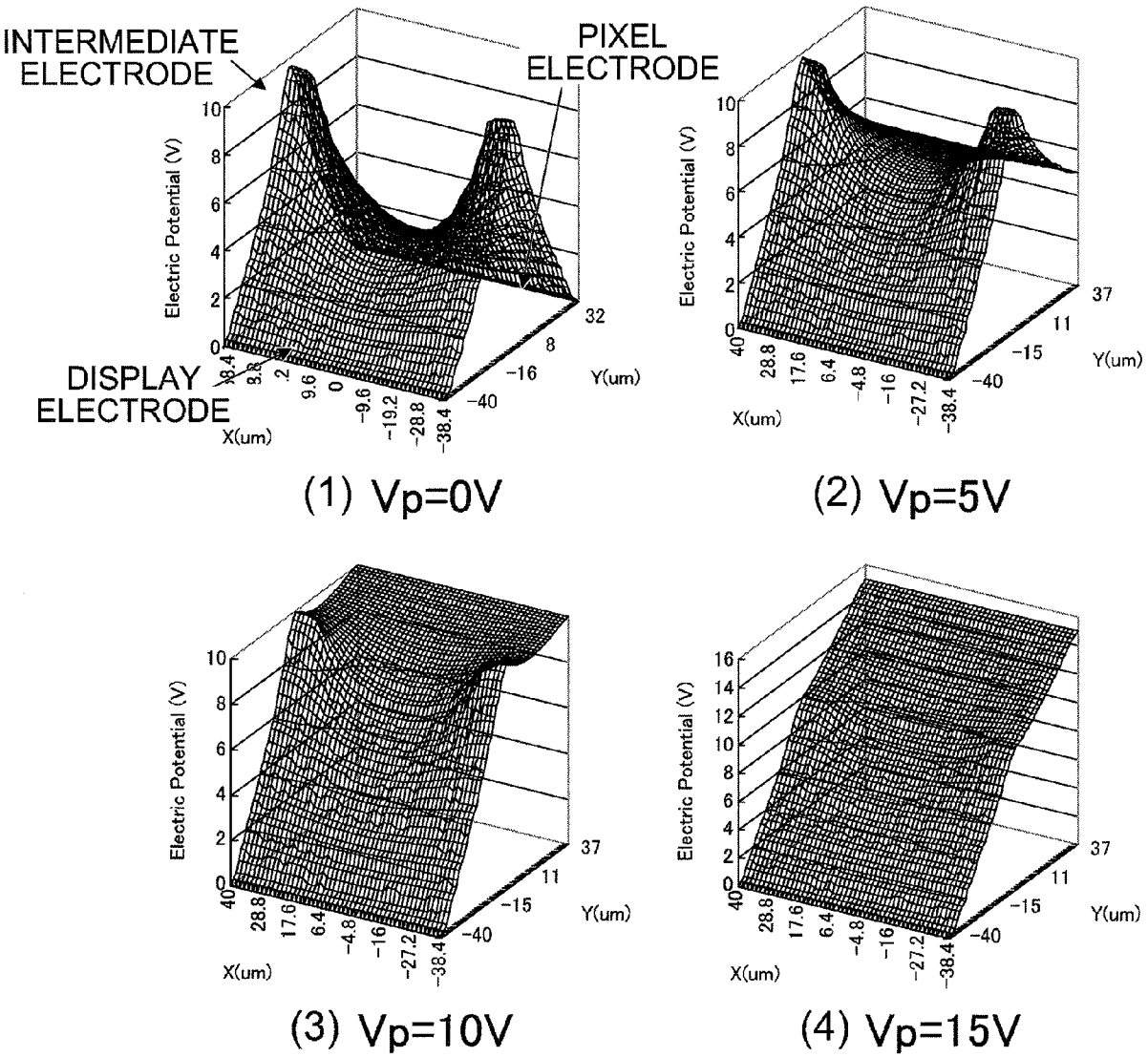
FIG. 7(1) to (4) are schematic diagrams showing field simulation results when voltages are applied to a display electrode, a pixel electrode and an intermediate electrode.

Furthermore, the results of electric field simulations are shown in FIG. 7 when voltages are applied to the display electrode 24, the pixel electrodes 26 and the intermediate electrode 34.

FIG. 7 shows equipotential curves representing electric field simulations with the test display medium employed in FIG. 6, with a voltage of 0V applied to the display electrode 24 thereof, a voltage of 10V applied to the intermediate electrode 34, and voltages of 0V, 5V, 10V, and 15V, applied to the pixel electrode 26, shown respectively in FIG. 7(1) to FIG. 7(4). Note that FIG. 7(1), FIG. 7(2), and FIG. 7(3) show respectively equipotential curves representing electric field simulations when a voltage of 0V is applied to the intermediate pixel electrode 26, a voltage of 5V is applied to the pixel electrode 26, and a voltage of 7.5V is applied to the pixel electrode 26. FIG. 7(4) shows a simulation result of the electrical potential surface when a voltage of 10V is applied to the pixel electrode 26.

As shown in FIG. 7, when the voltage applied to the pixel electrode 26 is a voltage of 10V, this being the voltage applied to the intermediate electrode 34, or less (FIG. 7(1) to FIG. 7(2)) then a potential barrier occurs from the pixel electrode 26, between the pixel electrode 26 and the display electrode 24. Consequently, when the voltage applied to the pixel electrode 26 is the voltage applied to the intermediate electrode 34 or less, the particle groups 40 moving from the pixel electrode 26 side to the display substrate 20 side cannot pass through the apertures 34A of the intermediate electrode 34 due to the potential barrier formed by the intermediate electrode 34.

However, when the voltage applied to the pixel electrode 26 is a voltage that exceeds the voltage of 10V applied to the intermediate electrode 34 (FIG. 7(3) to FIG. 7(4)), a potential barrier does not occur from the pixel electrode 26, between the pixel electrode 26 and the display electrode 24. Consequently, when the voltage applied to the pixel electrode 26 is a voltage exceeding the voltage applied to the intermediate electrode 34, the particle groups 40 moving from the pixel electrode 26 side to the display substrate 20 side can pass through the apertures 34A of the intermediate electrode 34.

Therefore, as shown by Formula (1), conditions under which the particle groups 40 can pass from the plural pixel electrodes 26 side to the display electrode 24 side through the apertures 34A may be achieved by, in the first process, satisfying the relationship $G \leq P$ of Formula (1) for the potential difference P between the pixel electrode $\mathbf{26}_1$, out of the plural pixel electrodes 26, provided at a position corresponding to one of the pixels where the particle groups 40 are to be moved, and the display electrode 24, and the potential difference G between the pixel electrode $\mathbf{26}_1$ and the intermediate electrode 34.

When the simulation results of FIG. 6 and FIG. 7 are combined, conditions under which the particle groups 40 can pass from the plural pixel electrodes 26 side to the display electrode 24 side through the apertures 34A may be achieved by, in the first process, satisfying the relationship $P/2 \leq G \leq P$ of Formula (1) for the potential difference P between the pixel electrode $\mathbf{26}_1$, out of the plural pixel electrodes 26, provided at a position corresponding to one of the pixels where the particle groups 40 are to be moved, and the display electrode 24, and the potential difference G between the pixel electrode $\mathbf{26}_1$ and the intermediate electrode 34.

Take the example when a voltage of 0V is applied to the display electrode 24, or the display electrode 24 is in a grounded state, the voltage applied to the pixel electrode 26 is continuously varied from 0V, generating a potential difference, and the particle groups 40 are charged with a positive polarity so as to move when a voltage of 10V or greater is applied to the particle groups 40 (namely a potential difference of 10V).

In such cases, when the particle groups 40 are moved from the plural pixel electrodes 26 side towards the display electrode 24 side, during the period of time A for performing the first process (see FIG. 5A), a voltage Vc of 0V is applied to the display electrode 24, a voltage Vp of 10V is applied to the pixel electrode $\mathbf{26}_1$, and a voltage Vg of 5V is applied to the intermediate electrode 34, so as to satisfy Formula (1) above.

Note that during the first process, the voltage applied to the pixel electrode $\mathbf{26}_1$, that is a pixel electrode 26 corresponding to a pixel where the particle groups 40 are to be moved, may be any voltage value and voltage application duration that moves particle groups 40 from the pixel electrode 26 side towards the display electrode 24 side. Therefore, as described above, as long as the particle groups 40 moved when a voltage of 10V or greater is applied to the pixel electrode 26 when the display electrode 24 is at 0V or in a grounded state, the voltage Vp applied to the pixel electrode $\mathbf{26}_1$ is a voltage value 10V or greater, and the duration of application of this voltage value is until the particle groups 40 have passed through the apertures 34A.

However, in cases where the particle groups 40 are being moved from the plural pixel electrodes 26 side to the display electrode 24 side, for the period of time B for performing the second process, the voltages applied to the pixel electrode 26 and the intermediate electrode 34 may be any voltages that move the particle groups 40 that have passed through the apertures 34A, and the particle groups 40 that have not passed through the apertures 34A, towards the substrate in the opposite directions.

For example, in the second process, a voltage of the same voltage value and voltage polarity to that of the first process (a voltage that is not 0V) may continue to be applied to the intermediate electrode 34, and 0V, this being the voltage value the same as the voltage Vc applied to the display electrode 24, may be applied as the voltage Vp to the pixel electrode $\mathbf{26}_1$. Furthermore, the duration of application of the voltage Vp of this voltage value should be a duration until the particle groups 40 that have passed through, or not passed through, the apertures 34A reach each of the opposite direction substrates.

From the standpoint of forming an electric field that separates the particle groups 40 from the intermediate electrode 34 more vigorously, as the period of time B for the duration of the second process shown in FIG. 5A, the voltage Vp applied to the pixel electrode $\mathbf{26}_1$ may be 0V, this being the same voltage value as the voltage Vc applied to the display electrode 24, and the voltage value of the voltage Vg applied to the intermediate electrode 34 may be a value of greater absolute value than the voltage value applied to the intermediate electrode 34 during the first process, and of the same polarity as the polarity of the particle groups 40.

Explanation follows of moving the particle groups 40 from the display electrode 24 side towards the pixel electrode 26 side.

In a similar manner, when moving the particle groups 40 from the display electrode 24 side towards the pixel electrode 26 side, the above second process may also be performed after performing the first process.

However, when moving the particle groups 40 from the display electrode 24 side towards the pixel electrode 26 side, the electrical potential of the display electrode 24 and the intermediate electrode 34 may be the same electrical potential as in the first process (see FIG. 5B).

Figure 9A:
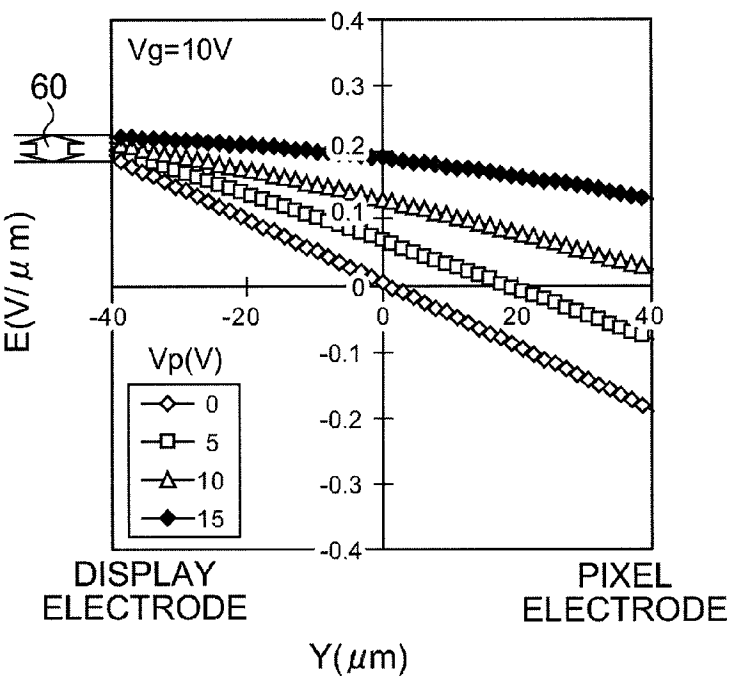
FIG. 9A and FIG. 9B are diagrams showing field simulation results confirming that the display electrode and the intermediate electrode may be at the same electrical potential in a first process when particle groups disposed at the display electrode side are moved to the pixel electrode side.
Figure 9B:
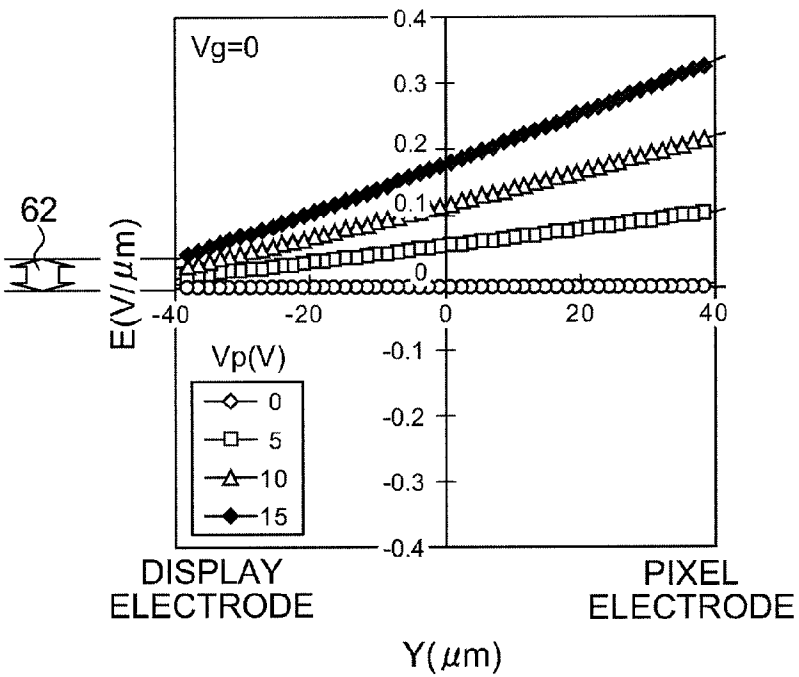

FIG. 9A and FIG. 9B show simulation results confirming that the electrical potentials of the display electrode 24 and the intermediate electrode 34 may be the same in the first process when the particle groups 40 disposed at the display electrode 24 side are moved to the pixel electrode 26 side.

FIG. 9A shows, in a case employing the above test display medium A, simulation results of changing the electric field intensity along a normal to the substrates at the center of the apertures 34A when respective voltages of voltage values 0V, 5V, 10V, and 15V are applied to the pixel electrode 26 in a state in which a voltage of 0V is applied to the display electrode 24 of the test display medium A, and a voltage of voltage value 10V is applied to the intermediate electrode 34.

Furthermore, FIG. 9B shows simulation results of changing the electric field intensity along a normal to the substrates at the center of the apertures 34A, when respective voltages of voltage values 0V, 5V, 10V, and 15V are applied to the pixel electrode 26 in a state in which a voltage of 0V is applied to the display electrode 24 of the test display medium A, and a voltage of 0V is applied also to the intermediate electrode 34.

As shown in FIG. 9A, when the voltage value of the voltage applied to the pixel electrode 26 is varied in a range from 0V to 15V, under conditions in which the voltage applied to the display electrode 24 is a voltage value of 0V and the voltage applied to the intermediate electrode 34 is a voltage value of 10V, there is a change in the vicinity of the display electrode 24 in a range from a minimum of 0.18 V/μm to a maximum of 0.22 V/μm, as shown by the annotation 60. Due to the migration speed of the particle groups 40 being proportional to the field intensity, the relative speed of the fastest particles to the slowest particles is 122% (=0.22/0.18). This relative speed is preferably 300% or greater, as described later, and so in comparison to the desired relative speed, such a value is insufficient.

However, as shown in FIG. 9B, when the voltage value of the voltage applied to the pixel electrode 26 is varied in a range from 0V to 15V, under conditions in which the voltage applied to the display electrode 24 is a voltage value of 0V and the voltage applied to the intermediate electrode 34 is a voltage value of 0V, there is a change in the vicinity of the display electrode 24 in a range from a minimum of 0 V/μm to a maximum of 0.05 V/μm, as shown by the annotation 62. In such a case, the relative speed of the fastest particles to the slowest particles approaches infinity, and it can be seen that sufficient speed difference is secured.

From the above, it can be seen that when the particle groups 40 disposed on the display electrode 24 side are moved to the pixel electrode 26 side, in the first process, it is good to make the display electrode 24 and the intermediate electrode 34 the same electrical potential, from the standpoint of achieving a good degree of modulation in the electric field at the intermediate electrode 34 side. This is because the electric field caused by the potential difference between the display electrode 24 and the intermediate electrode 34, and the electric field caused by the potential difference between the display electrode 24 and the pixel electrode 26, are superimposed on each other in the vicinity of the display electrode 24. By making the value of the former electric field zero, the effect of the later electric field is enhanced.

As explained above, according to the display device 10 of the present exemplary embodiment, after performing the first process such that the particle groups 40 positioned in regions corresponding to pixels subject to movement are caused to pass through the apertures 34A of the intermediate electrode 34, and the particle groups 40 positioned in regions corresponding to pixels other than those subject to movement do not pass through the apertures 34A of the intermediate electrode 34, the second process is performed such that the particle groups 40 that have passed through the apertures 34A are moved towards the passing destination substrate side, and the particle groups 40 that have not passed through the apertures 34A are moved towards the substrate on the opposite side to that of passing destination substrate.

Consequently, the particle groups 40 are moved to the display substrate 20 side or to the back substrate 22 side, suppressing particles from floating around therebetween, and as a result, there is an improvement in color separation when displaying a different color to a given color currently displayed.

Note that for the particle groups 40 employed in the display device 10 of the present exemplary embodiment, preferably, from the standpoint performing display with clear contrast, when the particle groups 40 that have passed through the apertures 34A of the intermediate electrode 34 due to the first process have moved to a position that is exactly in the middle between the intermediate electrode 34 and the electrode at the movement destination side (the display electrode 24), the particle groups 40 in regions corresponding to non-movement pixels are preferably still positioned at locations prior to the central position between the electrode where the particle groups 40 were positioned before the first process (the pixel electrode 26) and the intermediate electrode 34 (in this case positioned further to the pixel electrode 26 side).

Figure 8B:
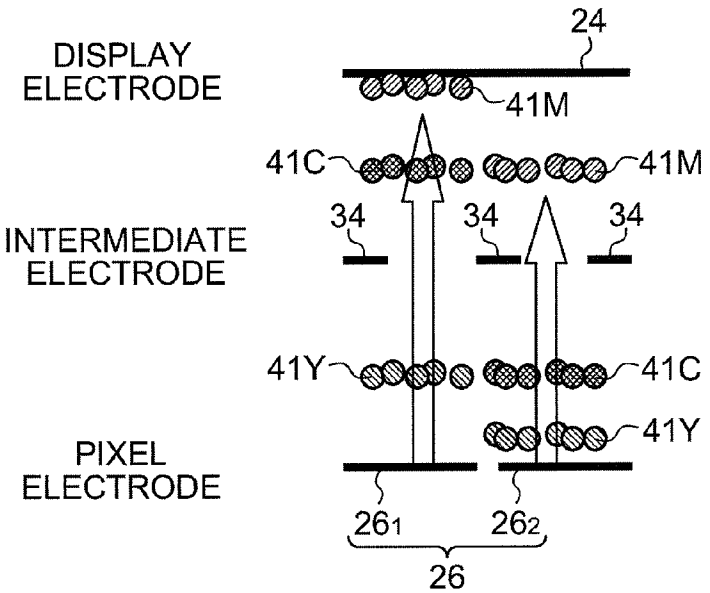
FIG. 8B is a schematic diagram showing a preferred state of migration speeds of particle groups in a display device of a second exemplary embodiment.
Figure 8A:
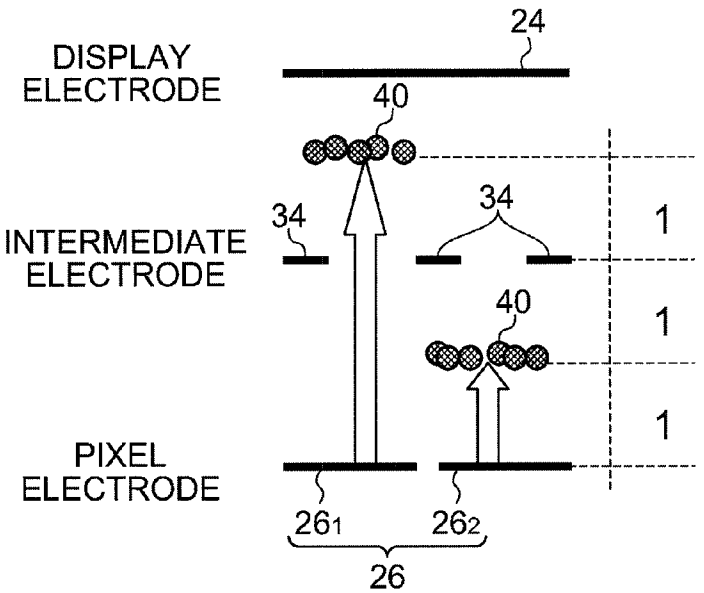
FIG. 8A is a schematic diagram showing a preferred state of migration speeds of particle groups in a display device of the first exemplary embodiment.

Specifically, as shown in FIG. 8A, in cases where the intermediate electrode 34 is provided at a position exactly central between the display electrode 24 and the pixel electrode 26, when voltages are applied to the display electrode 24, the pixel electrodes 26 and the intermediate electrode 34 in the period of time A for performing the first process, the migration speed ratio of the particle groups 40 that have passed through the apertures 34A to the particle groups 40 that have not passed through the apertures 34A is preferably 3:1 or greater.

For example, the configuration of the display medium 12, the separation distances between the display electrode 24, the intermediate electrode 34, and the pixel electrode 26, the constitution of the particle groups 40, the voltage value of the voltage applied for the first process duration, and the like may be adjusted in order to achieve such movement.

Note that while explanation has been given in the present exemplary embodiment of a case where there is a single type of the particle groups 40 contained in the display medium 12, plural types of particle groups may be employed as the particle groups moving according to the electric field between the substrates, with these plural types of particle group having the same polarity but different migration properties.

In such cases, voltages may be applied to the display electrode 24 and the plural pixel electrodes 26 such that the type(s) of particle groups subject to movement from the plural types of particle pass through the apertures 34A of the intermediate electrode 34, and the types of particle groups not subject to movement from the plural types of particle do not pass through the apertures 34A, these types of particle having lower migration properties than the particles subject to movement.

In the second process performed in succession after the first process, voltages may be applied to the display electrode 24, the plural pixel electrodes 26 and the intermediate electrode 34 such that: the particle groups of the type(s) of particle groups subject to movement that have passed through the apertures 34A of the intermediate electrode 34 due to the first process are moved towards the downstream substrate from the pair of substrates in the direction of passing of the particle groups of the type(s) of particles subject to movement; and the types of particle groups not subject to movement that have not passed through the apertures 34A of the intermediate electrode 34 due to the first process, are moved towards the substrate facing the downstream substrate.

Second Exemplary Embodiment

Explanation is given above in the first exemplary embodiment of a case where there is one type of the particle groups 40 contained in the display medium 12, however, in the present exemplary embodiment, explanation follows of an embodiment that employs, as particle groups moved between the substrates according to an electric field, plural types of particle groups having the same polarity but different migration properties. In the present exemplary embodiment, explanation follows of a case where, the first process and the second process, performed in succession after the first process, are repeatedly executed in sequence on the particle groups 41 from the types of particle groups with the lowest migration properties by determining, from the particle groups subject to movement, the first particle groups of the particle groups subject to movement in sequence from the lowest migration properties.

Figure 10:
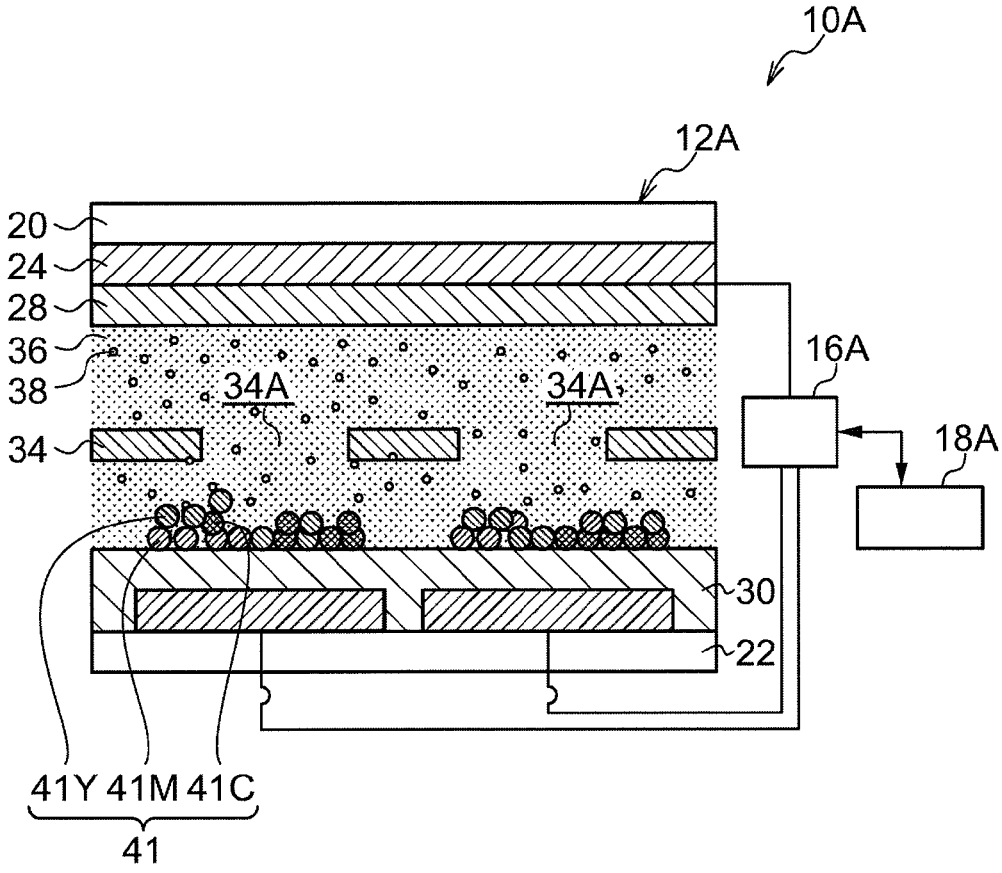
FIG. 10 is a schematic configuration diagram showing an example of a display device according to the second exemplary embodiment.

As shown in FIG. 10, a display device 10A according to the present exemplary embodiment is configured including a display medium 12A, a voltage application section 16A that applies a voltage to the display medium 12A, and a control section 18A that controls driving of the voltage application section 16A. The control section 18A is connected to the voltage application section 16A in such a manner as to be able to send and receive signals to and from the voltage application section 16A.

The display device 10A corresponds to the display device of the present invention, and the voltage application section 16A and the control section 18A correspond to the voltage application device in the display device of the present invention.

The display medium 12A includes a display substrate 20 and a back substrate. A dispersion medium 36 is filled between the substrates, the display substrate 20 and the back substrate 22, and white colored particles 38 are dispersed in the dispersion medium 36. Also dispersed in the dispersion medium 36 are plural types of particle groups, these being particle groups 41Y, particle groups 41C, and particle groups 41M, that move between the substrates according to an electric field formed between the substrates, the display substrate 20 and the back substrate 22. The plural types of particle groups having the same polarity but different migration speeds. Reference to the particle groups 41 in the explanation refers to the plural types of the particle groups 41Y, the particle groups 41C, and the particle groups 41M in general.

Note that while explanation in the present exemplary embodiment is of a case where the plural types of particle groups 41 encapsulated in the display medium 12A are of three types of the particle groups 41, there may be two or more types thereof, and there is no limitation to three types. As long as these plural types of particle groups 41 (the particle groups 41Y, the particle groups 41C, and the particle groups 41M) have the same polarity and different migration speeds, they may be either the same color as each other, or different colors from each other. Note that when they are of the same color, modulation of density may be achieved by moving particular type(s) of particle groups, and multi-colored display may be realized by the plural types of particle groups when the particle groups are of different colors from each other. Furthermore, there should be a region of overlap in the field intensities for moving the plural types of particle groups 41 between the substrates. Namely, while the particle groups 41 have different migration properties when given voltages are applied to the display electrode 24 and the pixel electrode 26, a voltage region should exist where that all of the types of particle groups 41 are moved.

Note that while, for ease of explanation, a case in the present exemplary embodiment is given where plural types of particle groups 41 differ in migration speeds as the migration properties, the particle groups 41 may differ in voltage threshold values, or may differ in both migration speed and voltage threshold values.

Furthermore, as described above, the particle groups 41Y, the particle groups 41C, and the particle groups 41M are plural types of particle groups 41 having the same polarity, and mutually different migration speeds. Therefore, the particle groups 41Y, the particle groups 41C, and the particle groups 41M are moved by application of a voltage between the substrates, and mutually different movement separation distances are achieved by adjusting the duration of voltage application.

These particle groups 41 may be manufactured using the same materials as the examples of constituent materials of the particle groups 40 given in the first exemplary embodiment. The respective migration speed and polarity of the plural types of particle groups 41 are determined, for example, by the surface flow resistance to the dispersion medium 36, the average charge amount, the particle size, the shape factor, the constituent materials and the like of each of the particles configuring each type of the particle groups 41. Therefore, the plural types of particle groups 41, having the same polarity and differing migration speed, can be prepared by adjusting, for example, the flow resistance, the average charge amount, the particle size, the shape factor, the constituent materials and the like of the particle groups 41Y, the particle groups 41C, and the particle groups 41M, respectively.

The display substrate 20 is provided in sequence with a display electrode 24 and an insulation layer 28. The back substrate 22 is provided in sequence with plural pixel electrodes 26 and an insulation layer 30. An intermediate electrode 34 is provided between the display substrate 20 and the back substrate 22.

Note that since the display medium 12A of the present exemplary embodiment is of similar configuration to that of the display medium 12 explained in the first exemplary embodiment, except for the plural types of particle groups 41 (particle groups 41Y, the particle groups 41C, and the particle groups 41M) replacing the particle groups 40 encapsulated in the display medium 12, the same reference numerals are allocated to components having the same functions, and detailed explanation thereof is omitted.

Explanation follows of the operation of the display device 10A of the present exemplary embodiment.

In the following, explanation is of a case where the particle groups 41 are configured from three types of particle groups 41 of mutually different colors, these being yellow colored particle groups 41Y, cyan colored particle groups 41C, and magenta colored particle groups 41M. More precisely, explanation is of a case where the sequence from the slowest migration speed is particle groups 41Y, followed by particle groups 41C, followed by particle groups 41M (the migration speed of the particle groups 41Y<the migration speed of the particle groups 41C<migration speed of the particle groups 41M).

When moving the particle groups 41 between the substrates, the voltage application section 16A of the display device 10A in the present exemplary embodiment, under control of the control section 18A, performs the first process in a similar manner to the display device 10 explained in the first exemplary embodiment, and then performs the second process performed in succession after the first process. However, a point that differs from the display device 10 of the first exemplary embodiment is that in the voltage application section 16A of the display device 10A of the present exemplary embodiment, the first process and the second process performed in succession after the first process are repeatedly performed in sequence from the particle groups 41 with the slowest migration speed out of the plural types of particle groups 41 subject to movement.

Note that, with respect to the details regarding voltage application in the first process and the second process, processing is similar to processing of the first exemplary embodiment, except for adjusting voltage application duration according to the type of the particle groups 41, therefore detailed explanation thereof is omitted.

Reference above to "first process and the second process are repeatedly executed in sequence on the particle groups 41 from the slowest migration speed" indicates a case where, since plural repetitions need to be executed of movement between the substrates of the plural types of particle groups 41 in order to display a target color, a processing chain of the first process and the second process, performed after the first process, is executed repeatedly in sequence for the type of particle groups 41 with the slowest migration speed.

The requirement to execute plural repetitions of movement between the substrates of plural types of particle groups 41 indicates, for example, that in order to display the target color on particular pixels, for example, from a state in which the particle groups 41 of the particle groups 41Y, the particle groups 41C, and the particle groups 41M are positioned at the pixel electrode 26 side (or at the display electrode 24 side) there is a requirement to perform movement of the particle groups 41 between the substrates two or more times. Specifically, when displaying red in the region corresponding to the particular pixels in the display medium 12A, red needs to be realized by a subtractive color mix of magenta and yellow, as a state in which the particle groups 41M and the particle groups 41Y are positioned in this particular region. In order to achieve this display of red color from a state in which the particle groups 41 of the particle groups 41Y, the particle groups 41C, and the particle groups 41M are positioned on the pixel electrode 26 side (back substrate 22 side), plural repetitions are required of movement between the substrates of the plural types of particle groups 41.

In order to execute repetitions of the first process and the second process in sequence from the type of the particle groups 41 with the slowest migration speed, first process and second process must be performed according to each of the types of the particle groups 41. The voltage application duration for applying voltages to the display electrode 24, the intermediate electrode 34 and the plural pixel electrodes 26 may be adjusted in the first process and the second process in order to perform the first process and second process according to each of the types of the particle groups 41.

For example, the following may be undertaken when performing the first process for the type of particle groups 41 with the slowest migration speed. Specifically, a voltage should be applied to the pixel electrodes $\mathbf{26}_1$, out of the plural pixel electrodes 26, provided at positions corresponding to pixels where the particle groups 41Y are to be moved between the substrates, of a voltage value that moves the particle groups 41Y between the substrates, such that the particle groups 41Y that are the type of particle groups having the slowest migration speed pass through the apertures 34A of the intermediate electrode 34, with this voltage applied continuously until the particle groups 41Y have passed through the apertures 34A of the intermediate electrode 34. Furthermore, in the first process, a voltage should be applied to the pixel electrodes $\mathbf{26}_2$, out of the plural pixel electrodes 26, provided at the positions corresponding to pixels other than the pixels where the particle groups 41Y are to be moved between the substrates, of a voltage value that does not make the particle groups 41Y that are the type of particle groups having the slowest migration speed pass through the apertures 34A of the intermediate electrode 34.

In the first process, as explained in the first exemplary embodiment, a voltage should be applied to the intermediate electrode 34 of a voltage value such that the particle groups 41Y pass through the apertures 34A corresponding to the pixel electrodes $\mathbf{26}_1$ and the particle groups 41Y do not pass through the apertures 34A corresponding to the pixel electrodes $\mathbf{26}_2$.

Then, in the second process, voltages, of the voltage values applied in the second process as explained in the first exemplary embodiment, should be applied to the intermediate electrode 34 and the pixel electrode 26 over a continuous duration, until the particle groups 41Y that have passed through the apertures 34A due to the first process reach the substrate at the downstream side in the passing direction, and the particle groups 41Y that have not passed through the apertures 34A reach the substrate on the opposite side to the downstream substrate.

Note that in the first process and the second process, when moving a particular type of particle groups 41, out of the plural types of particle groups 41, the particle groups 41 types of faster migration speed than those of particular type of particle groups 41 also move. Namely, when moving the particle groups 41Y having the slowest migration speed between the substrates, the particle groups 41C and the particle groups 41M of types having faster migration speed than the particle groups 41Y are also moved.

Consequently, in the display device 10A of the present exemplary embodiment, the speeds and colors of each of the type of particle groups 41 may be adjusted in advance such that the target color is displayed in respective pixels by repeatedly executing the first process and the second process in sequence from the type of particle groups 41 having the slowest migration speed. Furthermore, in order to display the target color, the number of repetitions of the first process and the second process, and the voltage value and/or the voltage application duration of the voltages applied in each of the processes may be adjusted according to the characteristics (color and migration speed) of the adjusted plural types of particle groups 41.

Explanation follows of a specific example in the display device 10A of the present exemplary embodiment where three types of the colors of particle groups 41, the particle groups 41Y, the particle groups 41C, and the particle groups 41M, are moved between the substrates, performing display of respective colors.

Figure 11:
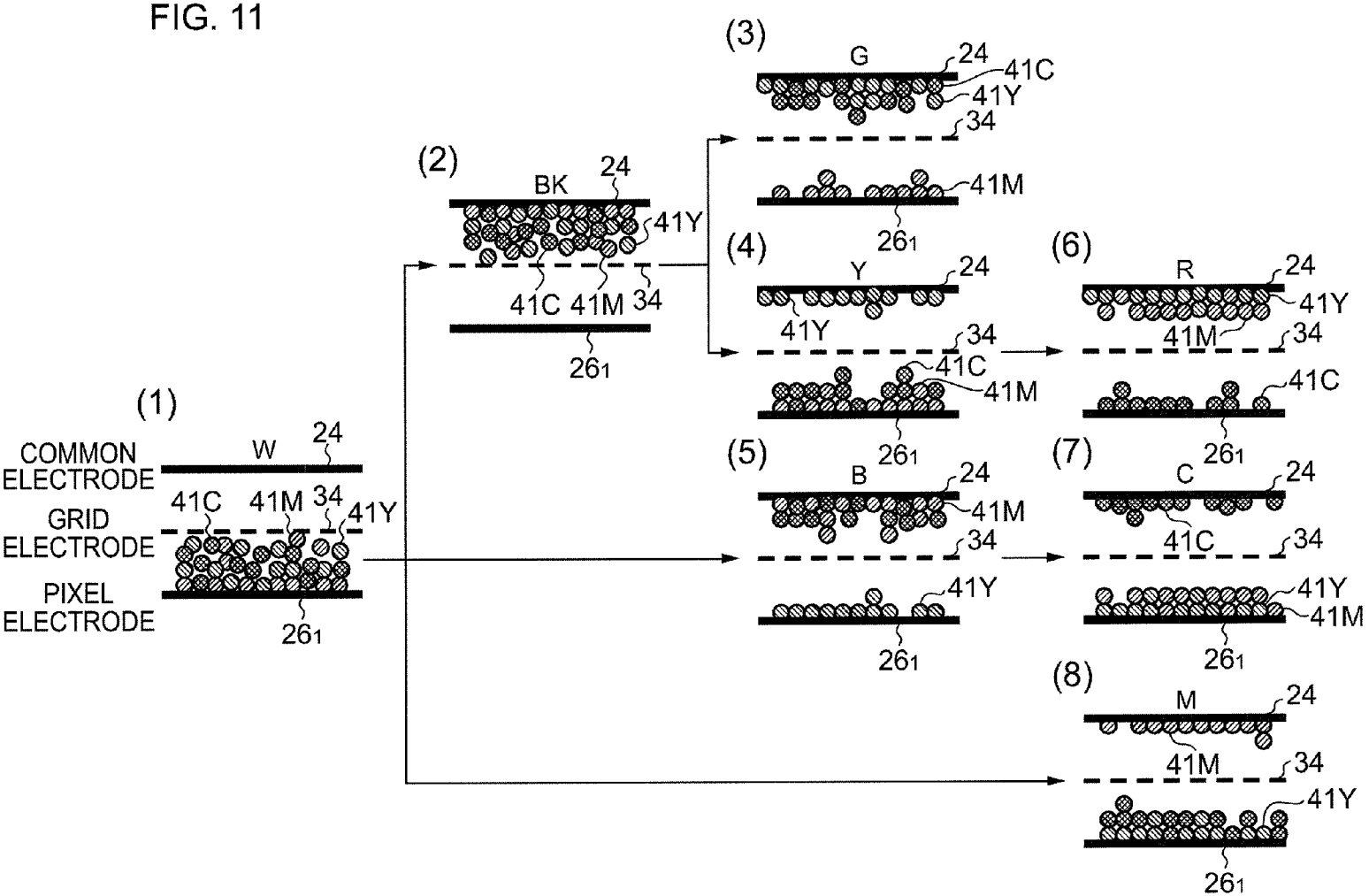
FIG. 11(1) to (8) are schematic diagrams showing multicolor display being performed in a display device according to the second exemplary embodiment.

In FIG. 11 explained below, an example is given focusing on a single display electrode (the pixel electrode $\mathbf{26}_1$) corresponding to a pixel where the particle groups 41 are to be moved in order to simplify explanation. Furthermore, explanation is given of a case where 0V is applied to the display electrode 24, or the display electrode 24 is in a grounded state. The particle groups 41Y, the particle groups 41C, and the particle groups 41M are also all charged with a positive polarity.

First, explanation follows of a case where, after first performing initialization processing that moves all of the types of particle groups 41 to the back substrate 22 side, this being the substrate on which the pixel electrodes 26 are provided, red (R) is displayed (see FIG. 11(5)) from this state in which all of the types of particle groups 41 (the particle groups 41Y, the particle groups 41C, and the particle groups 41M) are disposed at the back substrate 22 side (see FIG. 11(1)).

Figure 12:
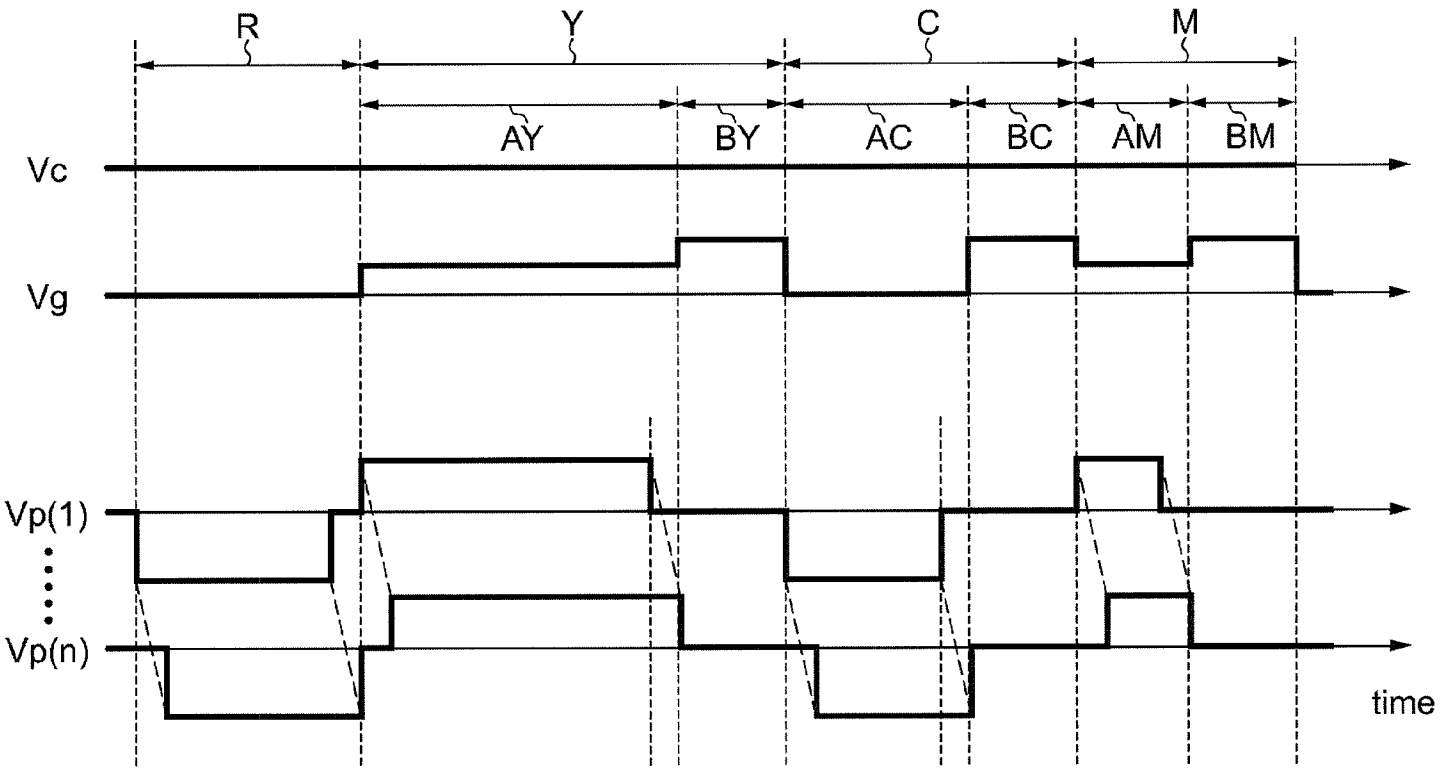
FIG. 12 is a schematic diagram showing an example of voltages applied to a display electrode, an intermediate electrode, and pixel electrodes corresponding to pixels subject to movement when plural types of particle group disposed at the pixel electrode side are moved in sequence from the type of particle group with the slowest migration speed during a first process and a second process in the second exemplary embodiment.

First, the initialization processing is performed and all of the types of particle groups 41 are moved to the side provided with the pixel electrodes 26 (see FIG. 11(1)). For this initialization processing, for a period of time R during which the initialization processing is performed, as shown in FIG. 12, a voltage Vc of 0V is applied to the display electrode 24, and a voltage Vg of 0V, the same as that of the display electrode 24, is applied to the intermediate electrode 34. A voltage Vp is also applied to all of the pixel electrodes 26, giving a potential difference to that display electrode 24 that moves all of the types of particle groups 41 to the pixel electrode 26 side (the back substrate 22 side). In the present exemplary embodiment, since the particle groups 41 are positively charged, a minus voltage Vp is applied.

The duration of application of this voltage to the pixel electrode 26 during the initialization processing is a duration for moving all of the types of particle groups 41 to the pixel electrode 26 side. Namely, it may be a duration of the period of time for the particle groups 41Y that have the slowest migration speed to move to the pixel electrode 26 side, and may be a duration adjusted according to the voltage value of the voltage applied and the migration speed and field intensity for movement of the plural types of particle groups 41.

Furthermore, voltage may be applied either simultaneously to all of the plural pixel electrodes 26, or applied as successive voltages. When successive voltage applications are made, as shown in FIG. 12, respective voltages voltage Vp (1) to voltage Vp (n) are applied to each of the respective plural pixel electrodes 26. Therefore, application of the voltage Vc to the display electrode 24, and application of the voltage Vg to the intermediate electrode 34, is made continuously until voltage application has been completed for all of the pixel electrodes 26.

Next, explanation follows of a case where red (R) is displayed (see FIG. 11(5)), from the state in which all of the types of particle groups 41 (the particle groups 41Y, the particle groups 41C, and the particle groups 41M) have been disposed at the back substrate 22 side (see FIG. 11 (1)) by the above initialization processing. When display is made of red (R) (see FIG. 11 (5)), in the final state, red (R) needs to be exhibited by a subtraction color mix of yellow and magenta, as a state in which only the particle groups 41Y and the particle groups 41C are present at the display substrate 20 side.

Therefore, first, the first process and the second process are performed for the particle groups 41Y, having the slowest migration speed out of the plural types of particle groups 41 (see the period of time Y in FIG. 12).

Specifically, as the first process for the particle groups 41Y, for a period of time AY (see FIG. 12) for performing the first process to the particle groups 41Y, a voltage Vc of 0V is applied to the display electrode 24, a voltage Vp, of a voltage value that moves the particle groups 41Y from the pixel electrode $\mathbf{26}_1$ side to the display electrode 24 side, is applied to the pixel electrode $\mathbf{26}_1$ for a continuous duration until the particle groups 41Y have passed through the apertures 34A. A voltage Vg, of a voltage value at a level that does not impede the particle groups 41Y from passing through the apertures 34A, is also applied to the intermediate electrode 34.

Furthermore, as shown in FIG. 12, the application of voltage is made sequentially to the respective pixel electrodes $\mathbf{26}_1$, out of the plural pixel electrodes 26, provided at positions corresponding to pixels where the particle groups 41Y are to be moved, so as to form a sequence of respective voltage applications of, voltage Vp (1) to voltage Vp (n), to each of these pixel electrodes $\mathbf{26}_1$ during the period of time AY for performing the first process to the particle groups 41Y. Therefore, the application of the voltage Vc to the display electrode 24 and the application of the voltage Vg to the intermediate electrode 34 is continued until voltage application is completed for all of these pixel electrodes 26.

Next, for a period of time BY for performing the second process to the particle groups 41Y (see FIG. 12), a voltage Vc of 0V is applied to the display electrode 24, and a voltage Vp of a voltage value that moves the particle groups 41Y is applied to the pixel electrode $\mathbf{26}_1$, such that due to the relationship to the voltage applied to the intermediate electrode 34, the particle groups 41Y that have passed through the apertures 34A of the intermediate electrode 34 move towards the display electrode 24 side. In the example shown in FIG. 12, during the period of time BY for performing the second process to the particle groups 41Y, a voltage of a higher voltage value than the voltage applied during the first process is applied to the intermediate electrode 34, and the voltage Vp of 0V, the same value as to the display electrode 24, is applied to the pixel electrode $\mathbf{26}_1$.

Note that, as explained in the first exemplary embodiment, the voltages applied to the pixel electrode $\mathbf{26}_1$ and the intermediate electrode 34 during the second process should be voltages that move the particle groups 41Y that have passed through the apertures 34A of the intermediate electrode 34 towards the substrate on the downstream side in the passing direction (the display electrode 24 side), and move the particle groups 41Y that have not passed through the apertures 34A to the opposite substrate side. Therefore, an embodiment may be made in which the voltage Vp of 0V, which is the same voltage as to the display electrode 24, is simply applied to the pixel electrode 26, and the voltage value applied to the intermediate electrode 34 is not changed. However, may making the voltage value for application to the intermediate electrode 34 a higher value (a voltage value with a greater absolute value) than the voltage value of the voltage applied to the intermediate electrode 34 during the first process, the particle groups 41Y are efficiently moved to the substrates on mutually opposing sides. This also applies below to the second process of the particle groups 41M and the particle groups 41C.

By performing the first process and the second process to the particle groups 41Y, in the regions corresponding to the pixel electrodes $\mathbf{26}_1$ provided at positions of pixels for moving the particle groups 41Y, the particle groups 41Y and the types of particle groups 41 that are faster than the particle groups 41Y (these being the particle groups 41C and the particle groups 41M) are moved to the display electrode 24 side (the display substrate 20 side). Due thereto, black is displayed in the regions corresponding to these pixel electrodes $\mathbf{26}_1$ from the subtraction color mix of yellow due to the particle groups 41Y, cyan due to the particle groups 41C, and magenta due to the particle groups 41M (see FIG. 11(2)).

Next, the first process and the second process are performed to the particle groups 41C with faster migration speeds than the particle groups 41Y and slower migration speeds than the particle groups 41M (see period of time C in FIG. 12).

In a period of time AC (see FIG. 12) for performing the first process to the particle groups 41C, a voltage Vc of 0V is applied to the display electrode 24 and a voltage Vp of a voltage value that moves the particle groups 41C from the display electrode 24 side to the pixel electrode $\mathbf{26}_1$ side is applied to the pixel electrode $\mathbf{26}_1$ continuously until the particle groups 41C have passed through the apertures 34A. A voltage Vg is also applied to the intermediate electrode 34 of a voltage value at a level that does not impede the passing of the particle groups 41C through the apertures 34A.

Furthermore, as shown in FIG. 12, the application of voltage is made sequentially to the respective pixel electrodes $\mathbf{26}_1$, out of the plural pixel electrodes 26, provided at positions corresponding to pixels where the particle groups 41C are to be moved, so as to form a sequence of respective voltage applications, of voltage Vp (1) to voltage Vp (n), to each of these pixel electrodes $\mathbf{26}_1$ during the period of time AC for performing the first process to the particle groups 41C. Therefore, the application of the voltage Vc to the display electrode 24 and the application of the voltage Vg to the intermediate electrode 34 is continued until voltage application is completed for all of these pixel electrodes $\mathbf{26}_1$.

Next, for a period of time BC for performing the second process to the particle groups 41C (see FIG. 12), a voltage Vc of 0V is applied to the display electrode 24, and a voltage Vp of a voltage value that moves the particle groups 41M is applied to the pixel electrodes $\mathbf{26}_1$, such that due to the relationship to the voltage applied to the intermediate electrode 34, the particle groups 41C that have passed through the apertures 34A of the intermediate electrode 34 move towards the display electrode 24 side. In the example shown in FIG. 12, in the period of time BC for performing the second process to the particle groups 41C, a voltage of a higher voltage value than during the first process is applied to the intermediate electrode 34, and the voltage Vp of 0V, the same value as to the display electrode 24, is applied to the pixel electrodes $\mathbf{26}_1$.

By performing the first process and the second process to the particle groups 41C, in the regions corresponding to the pixel electrodes $\mathbf{26}_1$ provided at positions of pixel for moving the particle groups 41C, the particle groups 41C and the particle groups 41M that are faster than the particle groups 41Y are moved to the pixel electrode $\mathbf{26}_1$ (back substrate 22) side. Due thereto, a state is achieved in which only the particle groups 41Y are present at the display substrate 20 side in the regions corresponding to these pixel electrodes $\mathbf{26}_1$ and yellow is displayed (see FIG. 11(4)).

Finally, the first process and the second process are performed for the particle groups 41M having the fastest migration speed (see period of time M in FIG. 12).

In a period of time AM for performing the first process to the particle groups 41M (see FIG. 12), a voltage Vc of 0V is applied to the display electrode 24, and voltage Vp of a voltage value that moves the particle groups 41M from the pixel electrode $\mathbf{26}_1$ side to the display electrode 24 side is applied to the pixel electrode $\mathbf{26}_1$ continuously until the particle groups 41M have passed through the apertures 34A. A voltage Vg of a voltage value at a level that does not impede the passing of the particle groups 41M through the apertures 34A is also applied to the intermediate electrode 34.

Furthermore, as shown in FIG. 12, the application of voltage is made sequentially to the respective pixel electrodes 26, out of the plural pixel electrodes 26, provided at positions corresponding to pixels where the particle groups 41M are to be moved, so as to form a sequence of respective voltage applications, of voltage Vp (1) to voltage Vp (n), to each of these pixel electrodes 26 during the period of time AM for performing the first process to the particle groups 41M. Therefore, the application of the voltage Vc to the display electrode 24 and the application of the voltage Vg to the intermediate electrode 34 is continued until voltage application is completed for all of these pixel electrodes $\mathbf{26}_1$.

Next, for a period of time BM for performing the second process to the particle groups 41M (see FIG. 12), a voltage Vc of 0V is applied to the display electrode 24, and a voltage Vp of a voltage value that moves the particle groups 41M is applied to the pixel electrodes $\mathbf{26}_1$, such that due to the relationship to the voltage applied to the intermediate electrode 34, the particle groups 41M that have passed through the apertures 34A of the intermediate electrode 34 move towards the display electrode 24 side. In the example shown in FIG. 12, in the period of time BM for performing the second process to the particle groups 41M, a voltage of a higher voltage value than during the first process is applied to the intermediate electrode 34, and the voltage Vp of 0V, the same value as to the display electrode 24, is applied to the pixel electrodes $\mathbf{26}_1$.

By performing the first process and the second process to the particle groups 41M, in the regions corresponding to the pixel electrodes $\mathbf{26}_1$ provided at positions of pixel for moving the particle groups 41M, the particle groups 41M are moved to the display electrode 24 (display substrate 20) side. Due thereto, a state is achieved in which the particle groups 41Y and the particle groups 41M are present at the display substrate 20 side in the regions corresponding to these pixel electrodes $\mathbf{26}_1$, and red (R) is displayed by a subtraction color mix of yellow and magenta (see FIG. 11(5)).

As described above, in order to display red it is necessary to move all of the types of particle groups 41 in sequence between the substrates, and so, from a state in which all of the type of particle groups 41 have been moved to the back substrate 22 side, the first process and the second process may be performed for each of the particle groups 41Y, the particle groups 41C, and the particle groups 41M, in sequence from the slowest migration speed.

However, when displaying green (G) from the initialized state (white display), since there is no need for a process that moves only the particle groups 41C and the particle groups 41M at the same time, green display is achieved from the initialized state (white display) shown in FIG. 11(1) by performing the first process and the second process in sequence on the particle groups 41Y and the particle groups 41M, in sequence from the slowest migration speed, in a similar manner to as described above (see FIG. 11(1), FIG. 11(2), and FIG. 11(3)).

In a similar manner, when displaying cyan (C) from the initialized state (white display), since there is no need for a process that moves the particle groups 41Y with the slowest migration speed, cyan (C) display is achieved from the initialized state (white display) shown in FIG. 11(1) by performing the first process and the second process in sequence on the particle groups 41C and the particle groups 41M, in sequence from the slowest migration speed, in a similar manner to as described above (see FIG. 11(1), FIG. 11(6), and FIG. 11(7)).

Furthermore, when displaying magenta (M) from the initialized state (white display), since only the particle groups 41M with the fastest migration speed need to be moved to the display substrate 20 side, magenta (M) display is achieved from the initialized state (white display) shown in FIG. 11(1) by performing the first process and the second process on the particle groups 41M (see FIG. 11(1) and FIG. 11(8)).

As explained above, in the display device 10A of the present exemplary embodiment, when moving the plural types of particle groups 41 between the substrates, the first process and the second process, performed in succession after the first process, are repeatedly executed on the particle groups 41 in sequence from the particle groups 41 with the slowest migration speed.

Consequently, even when multi-colored display is performed using the plural types of particle groups 41 having mutually different colors and migration properties, and having the same polarity, since the particle groups 41 are moved to the display substrate 20 side or to the back substrate 22 side, and particles are suppressed from floating around therebetween, as a result, there is an improvement in color separation when displaying a different color to a given color currently displayed.

Note that the plural types of particle groups 41 employed in the display device 10A of the present exemplary embodiment may, as described above, be particle groups 41 having mutually different migration speeds and the same polarity, and adjustment may be made to the speeds such that when the type of particle groups 41 subject to passing through the apertures 34A of the intermediate electrode 34 by the first process, have moved to a central position between the intermediate electrode 34 and the movement destination electrode (the display electrode 24), the types of particles 41 that are not subject to movement move so as to be positioned between the electrode positioned on the side where the particle groups 41 subject to movement were present before the first process (the pixel electrode 26) and the intermediate electrode 34. However, there is a difference to the first exemplary embodiment in the point that any particle groups 41 with a faster migration speed than those of the particle groups 41 to which processing is being performed need to be let through the apertures 34A of the intermediate electrode 34. In the first exemplary embodiment, the migration speed ratio of the particle groups 40 that have passed through the apertures 34A to the particle groups 40 that have not passed through the apertures 34A is preferably greater than 3:1, however, in the second exemplary embodiment, since the greater the migration speed ratio the longer the time taken for migration, the migration speed ratio is preferably in the vicinity of 3:1, that is to say preferably in the range of 1.5:1 to 4.5:1.

Specifically, when the intermediate electrode 34 is provided exactly in a central position between the display electrode 24 and the pixel electrode 26, as shown in FIG. 8B, the ratio of the migration speeds of the particle groups 41 with the faster migration speed (the particle groups 41M) to the particle groups 41 with the next fastest migration speed (the particle groups 41C) to the particle groups 41 with the slowest migration speed (the particle groups 41Y) may be 9:3:1.

In order to achieve such movement, for example, the configuration of the display medium 12, the separation distances between the display electrode 24, the intermediate electrode 34 and the pixel electrodes 26, the constitution of each of the types of the particle groups 41, and the voltage values of the voltages applied during the first process, and the like may be adjusted.

The foregoing description of the embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to are suited to the particular use contemplated. It is intended that the scope of the invention be defined by the following claims and their equivalents.

What is claimed is:

1. A display device comprising a voltage application device that performs processes with respect to a display medium comprising, a pair of substrates, at least one of the substrates being translucent, disposed facing each other and separated from each other, a plurality of types of particle groups disposed between the pair of substrates and moving according to an electric field formed between the substrates, the respective plurality of types of particle groups having the same polarity and a different color and migration properties, a first electrode disposed continuously at one or other of the pair of substrates, plural second electrodes disposed at the substrate opposite to the substrate where the first electrode is disposed, so as to respectively correspond to each pixel of an image subject to display, and a third electrode disposed between the pair of substrates and provided with apertures corresponding to each of the plurality of second electrodes whereby particle groups pass through along the facing direction of the pair of substrates, the voltage application device performing:

a first process of application of voltages to the first electrode and the plurality of second electrodes of voltages such that a first particle group from the plurality of types of particle groups passes through the aperture in the third electrode, and a second particle group from the plural types of particle groups, with lower migration properties than those of the first particle group, does not pass through the aperture of the third electrode; and in succession after the first process, a second process of application of voltages to the display medium to the first electrode, the plurality of second electrodes, and the third electrode such that the first particle group that has passed through the aperture in the third electrode due to the first process moves towards a downstream substrate of the pair of substrates disposed on the downstream side in the passing direction of the first particle group through the aperture, and the second particle group that has not passed through the aperture of the third electrode due to the first process moves towards the substrate on the side facing the downstream substrate, wherein the voltage application device, when moving the particle groups from the substrate on the side provided with the first electrode towards the substrate on the side provided with the plurality of second electrodes, applies a voltage to the third electrode in the first process of the same polarity and the same voltage value as the voltage applied to the first electrode.

2. The display device of claim 1, wherein the voltage application device, when performing display by moving the plurality of types of particle between the substrates a plural number of times, repeatedly executes a process chain of performing the first process then performing the second process on the particle groups selected as the first particle group from the plurality of types of particle groups in sequence, starting with the type with the lowest migration properties.

3. The display device of claim 1, wherein the voltage application device, when moving the particle groups from the substrate provided with the plurality of second electrodes towards the substrate provided with the first electrode, applies voltages to the first electrode, the plurality of second electrodes, and the third electrode in the first process such that the relationship between a potential difference P between the second electrode(s) and the first electrode, out of the plurality of second electrodes, provided at positions corresponding to pixels where the particle groups are to be moved, and a potential difference G between the third electrode and the first electrode, satisfy Formula (I) below:

$$P/2 \leq G \leq P \qquad \text{Formula (1).}$$

4. The display device of claim 1, wherein the voltage application device, applies a voltage to the third electrode in the second process of a greater absolute voltage value than the voltage value of the voltage that was applied to the third electrode during the first process performed successively just prior to the second process.

* * * * *